United States Patent [19]

Shuto et al.

[11] Patent Number: 4,675,279

[45] Date of Patent: Jun. 23, 1987

[54] SILVER HALIDE PHOTOGRAPHIC MATERIALS CONTAINING TABULAR SILVER HALIDE GRAINS AND A SPECIFIED SENSITIZING DYE

[75] Inventors: Sadanobu Shuto; Toshinao Ukai; Shunichi Aida, all of Kanagawa, Japan

[73] Assignee: Fuji Photo Film Co., Ltd., Kanagawa, Japan

[21] Appl. No.: 758,622

[22] Filed: Jul. 24, 1985

[30] Foreign Application Priority Data

Jul. 25, 1984 [JP] Japan ..... 59-154747

[51] Int. Cl.[4] ..... G03C 1/02; G03C 7/26

[52] U.S. Cl. ..... 430/567; 430/550; 430/574; 430/583

[58] Field of Search ..... 430/567, 583, 574, 550

[56] References Cited

U.S. PATENT DOCUMENTS

| | | | |
|---|---|---|---|
| 2,739,149 | 3/1956 | Lare | 430/558 X |
| 2,912,329 | 11/1959 | Jones et al. | 430/554 X |
| 4,510,234 | 4/1985 | Matsuzaka et al. | 430/567 X |
| 4,510,235 | 4/1985 | Ukai et al. | 430/574 |
| 4,552,837 | 11/1985 | Okazaki et al. | 430/550 |
| 4,555,481 | 11/1985 | Ukai et al. | 430/574 X |

FOREIGN PATENT DOCUMENTS

| | | | |
|---|---|---|---|
| 0042750 | 3/1985 | Japan | 430/574 |
| 654690 | 6/1951 | United Kingdom . | |
| 815172 | 6/1959 | United Kingdom . | |

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

A silver halide photographic light-sensitive material is described, which comprises a support having thereon at least one layer comprising a silver halide emulsion containing tabular silver halide particles wherein at least 50% of the total projected area of silver halide particles contained in the silver halide emulsion in said at least one layer is occupied by the tabular silver halide particles having an average aspect ratio of 5:1 or more, and wherein said silver halide emulsion contains a compound represented by general formula (I) or (II):

(I)

(II)

wherein a is an integer of 1 to 8;

$R_1$, $R_2$ and $R_3$, which are the same or different, each represents a group of the formula $-CH_2(CF_2)_bH$ or a substituted or unsubstituted alkyl group, with the proviso that at least one of $R_1$, $R_2$ and $R_3$ has an acid radical;

b, which is the same as or different from a, is an integer of 1 to 8;

l is 0 or an integer of 1 to 8; m is 0 or an integer of 1 to 8; with the proviso that $l+m>0$;

$R_4$, $R_5$ and $R_6$, which are the same or different, each represents a group of the formula $-(CH_2)_j(CF_2)_kF$ or a substituted or unsubstituted alkyl group, with the proviso that at least one or $R_4$, $R_5$ and $R_6$ has an acid radical;

j is 0 or an integer of 1 to 8; k is 0 or an integer of 1 to 8; with the proviso that $j+k>0$;

$V_1$, $V_2$, $V_3$, $V_4$, $V_5$, $V_6$, $V_7$ and $V_8$, which are the same or different, each represents a hydrogen atom, a halogen atom, a substituted or unsubstituted alkyl group, an alkoxy group, an acyl group, an acyloxy group, an alkoxycarbonyl group, a carbamoyl group, a sulfamoyl group, a cyano group or a trifluoromethyl group;

X is an anion; and n is 1 to 2; with the proviso that when said compound forms an internal salt, n is 1.

20 Claims, No Drawings

SILVER HALIDE PHOTOGRAPHIC MATERIALS CONTAINING TABULAR SILVER HALIDE GRAINS AND A SPECIFIED SENSITIZING DYE

FIELD OF THE INVENTION

The present invention relates to spectrally sensitized silver halide photographic emulsions, and in particular, to photographic materials having a silver halide photographic emulsion which contains tabular silver halide particles and which has an elevated spectral sensitivity especially in the green-sensitive region.

BACKGROUND OF THE INVENTION

Recently, silver halide emulsions containing tabular silver halide particles having a larger aspect ratio (=ratio of diameter to thickness of the particles) and having excellent spectral sensitivity and sharpness have been developed for use in silver halide photographic emulsions to be used in the photographic field. Silver halide emulsions of this kind have some defects in that, even though they are subjected to an optimum spectral sensitization by using a conventional sensitizing dye (for instance, benzimidazole), normal images cannot be obtained due to severe variations of sensitivity and gradation resulting from latensification after exposure, and that when they are preserved for a long period of time at a high temperature or at a high temperature and a high humidity, a remarkable increment in fog is inevitable, or the sensitivity becomes lowered with the lapse of time.

As is well known in the art, a spectral sensitization technique is applied to a process for the manufacture of photographic materials, in which a certain kind of a cyanine dye is added to a silver halide photographic emulsion so that the photosensitive wavelength region thereof may be expanded to the side of a longer wavelength. In this case, it is well known that the spectral sensitivity (that is, a sensitivity attained by such spectral sensitization) depends upon the chemical structure of the added sensitizing dye and various properties of the silver halide emulsion such as the halogen composition, crystal habit and crystal system of the silver halide, and the silver ion concentration and hydrogen ion concentration of the silver halide emulsion. In addition, the spectral sensitivity further depends upon some other photographic additives incorporated in the emulsion, such as a stabilizer, an antifoggant, a coating auxiliary, a flocculating agent, a color coupler and a hardener.

In addition, the sensitizing dyes to be used herein are required to that they do not have any adverse mutual effects to and from any other co-existing color couplers than the sensitizing dye or any other co-existing photographic additives, and that they may still keep the stable photographic characteristics even when the photographic materials are preserved for a long period of time.

Moreover, the sensitizing dyes must satisfy further requirement that the photographic materials, after photographically processed, are free from any remaining coloration resulting from the used sensitizing dye. In particular, it is especially important that no remaining coloration occurs in a rapid photographic processing to be carried out within a short period of time (in general, several seconds to several ten seconds).

Furthermore, the sensitizing dyes must satisfy the still further requirement that the occurrence of fog resulting from the used sensitizing dye is as little as possible.

It is well known that the addition of a certain kind of a benzimidazolocarbocyanine dye is extremely effective for the purpose of increasing the greensensitivity of silver halides as disclosed in, e.g., U.S. Pat. Nos. 2,912,329 and 2,739,149 and British Patent Nos. 654,690 and 815,172.

However, conventional benzimidazolocarbocyanine dyes are disadvantageous in that the increment of fog is remarkable when the photographic materials coated with a silver halide emulsion containing the dye are kept under the condition of a high temperature or of a high temperature and a high humidity and that the stability of the photographic materials i.e., stability of the emulsion after coating with the lapse of time is poor, resulting in a noticeable decrease in the sensitivity thereof. Improvement or elimination of the abovedescribed defects involved in the use of the known benzmidazolocarbocyanine dyes, including the increment of fog under the condition of a high temperature or of a high temperature and a high humidity and the decrease of the sensitivity with the lapse of time, is one of important subjects in the techniques for manufacturing photographic light-sensitive materials.

SUMMARY OF THE INVENTION

Accordingly, an object of the present invention is to provide silver halide photographic materials containing a tabular silver halide particle-emulsion, which have been spectrally sensitized and have a high green-sensitivity.

Another object of the present invention is to provide silver halide photographic materials containing a tabular silver halide particle-emulsion, which have good latent image stability, in particular, less variation of sensitivity and gradation resulting from latensification after exposure and less increment of fog during storage for a long period of time.

Still another object of the present invention is to provide sensitizing dyes having a high spectral sensitivity and little remaining coloration, which are suitable for tabular silver halide particles which are free from the occurrence of fog and have a good shell life for a long period of time.

Extensive studies have been carried out in an effort to elevate the spectral sensitivity and to elevate the latent image stability and the stability of other photographic properties in a non-exposed state, by supersensitizing the tabular silver halide particle-emulsion having a high aspect ratio hereunder defined, and as a result, it has been found that the use of a certain kind of a sensitizing dye is effective for the above-described purposes. The present invention is based this discovery.

Therefore, the present invention provides a silver halide photographic light-sensitive material comprising a support having thereon at least one silver halide emulsion layer, wherein at least 50% of the total projection area of silver halide particles contained in at least one of said at least one silver halide emulsion layers comprises tabular silver halide particles having an average aspect ratio of 5:1 or more, and wherein said emulsion contains a compound represented by general formula (I) or (II):

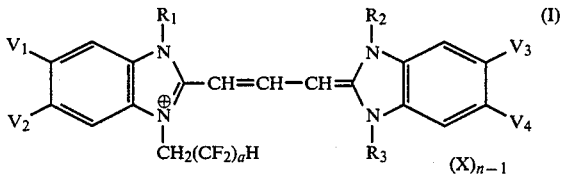

(I)

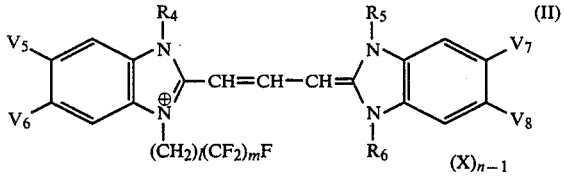

(II)

wherein a is an integer of 1 to 8;

$R_1$, $R_2$ and $R_3$, which are the same or different, each represents a group of the formula $—CH_2(CF_2)_bH$ or a substituted or unsubstituted alkyl group, with the proviso that at least one of $R_1$, $R_2$ and $R_3$ has an acid radical;

b, which is the same as or different from a, is an integer of 1 to 8;

l is 0 or an integer of 1 to 8; m is 0 or an integer of 1 to 8; with the proviso that $l=m>0$;

$R_4$, $R_5$ and $R_6$, which are the same or different, each represents a group of the formula $—(CH_2)_j(CF_2)_kF$ or a substituted or unsubstituted alkyl group, with the proviso that at least one of $R_4$, $R_5$ and $R_6$ has an acid radical;

j is 0 or an integer of 1 to 8; k is 0 or an integer of 1 to 8; with the proviso that $j+k>0$;

$V_1$, $V_2$, $V_3$, $V_4$, $V_5$, $V_6$, $V_7$ and $V_8$, which are the same or different, each represents a hydrogen atom, a halogen atom, a substituted or unsubstituted alkyl group, a substituted or unsubstituted alkoxy group, a substituted or unsubstituted acyl group, a substituted or unsubstituted acyloxy group, a substituted or unsubstituted alkoxycarbonyl group, a substituted or unsubstituted carbamoyl group, a substituted or unsubstituted sulfamoyl group, a cyano group or a trifluoromethyl group;

X is an anion; and n is 1 or 2; with the proviso that when the dye forms an internal salt, n is 1.

DETAILED DESCRIPTION OF THE INVENTION

Now, the present invention will be explained in more detail in the following description.

In the above described general formulae (I) and (II), preferred substituents are mentioned below.

$R_1$, $R_2$ and $R_3$, which are the same or different, each represents a group of the formula $—CH_2(CF_2)_bH$ (where b, which is the same as or different from a, is an integer of 1 to 8), e.g., $—CH_2CF_2H$, $—CH_2CF_2CF_2H$, $—CH_2CF_2CF_2CF_2H$, $—CH_2CF_2CF_2CF_2CF_2H$, $—CH_2(CF_2)_6H$, $—CH_2(CF_2)_8H$, etc., or an unsubstituted alkyl group having 1 to 6 carbon atoms (for example, a methyl group, an ethyl group, a propyl group, a butyl group, a pentyl group, a vinylmethyl group, a cyclohexyl group), or a substituted alkyl group having 1 to 16 total carbon atoms, i.e., an alkyl group having 1 to 6 carbon atoms and having a substituent selected from the group consisting of a carboxyl group, a sulfo group, a cyano group, a halogen atom (such as a fluorine atom, a chlorine atom, a bromine atom), a hydroxyl group, an alkoxycarbonyl group having 2 to 8 carbon atoms (such as a methoxycarbonyl group, an ethoxycarbonyl group, a phenoxycarbonyl group, a benzyloxycarbonyl group), an alkoxy group having 1 to 8 carbon atoms (such as a methoxy group, an ethoxy group, a benzyloxy group, a phenethyloxy group), a monocyclic aryloxy group having 6 to 10 carbon atoms (such as a phenoxy group, a, p-tolyloxy group), an acyloxy group having 1 to 3 carbon atoms (such as an acetyloxy group, a propionyloxy group), an acyl group having 1 to 8 carbon atoms (such as an acetyl group, a propionyl group, a benzoyl group, a mesyl group), a carbamoyl group (such as a carbamoyl group, an N,N-dimethylcarbamoyl group, a morpholinocarbonyl group, a piperidinocarbonyl group), a sulfamoyl group (such as a sulfamoyl group, an N,N-dimethylsulfamoyl group, a morpholinosulfonyl group, a piperidinosulfonyl group) and an aryl group having 6 to 10 carbon atoms (such as a phenyl group, a p-hydroxyphenyl group, a p-chlorophenyl group, a p-carboxyphenyl group, a p-sulfophenyl group, a p-methylphenyl group, an α-naphthyl group).

$R_4$, $R_5$ and $R_6$, which are the same or different, each represents group of the formula $—(CH_2)_j(CF_2)_kF$ (where j and k, which are the same or different, each is 0 or an integer of 1 to 8, with the proviso that $j+k>O$) e.g., $—CH_2CF_3$, $—CH_2CF_2CF_3$, $—CH_2CF_2CF_2CF_3$, $—CH_2CH_2F$, $—CH_2(CF_2)_4F$, $—CH_2(CF_2)_6F$, $—CH_2(CF_2)_8F$, etc., or has the same meaning as $R_1$, $R_2$ and $R_3$ above.

At least one of $R_1$, $R_2$ and $R_3$ and at least one of $R_4$, $R_5$ and $R_6$ are an acid radical such as, for example, a sulfonic acid group or carboxylic acid group, preferably an alkyl group having 1 to 6 carbon atoms having a sulfo group or a carboxyl group or a substituted alkyl group having 1 to 10 carbon atoms having a sulfo group or a carboxylic group, e.g., $—CH_2COOH$, $—CH_2CH_2COOH$, $—CH_2CH_2SO_3H$, $—CH_2CH_2CH_2COOH$, $—CH_2CH_2CH_2SO_3H$, $—CH_2CH_2CH_2CH_2CH_2COOH$, $—CH_2CH_2CH_2CH_2SO_3H$, $—CH_2CH_2CH_2CH_2CH_2SO_3H$, $—CH_2CH(CH_3)CH_2SO_3H$, etc.

$V_1$, $V_2$, $V_3$, $V_4$, $V_5$, $V_6$, $V_7$ and $V_8$, which are the same or different, each represents a hydrogen atom, a halogen atom (such as a fluorine atom, a chlorine atom, a bromine atom), an alkyl group having 1 to 6 carbon atoms (such as a methyl group, an ethyl group, a vinylmethyl group, a cyclohexyl group), an acyl group having 1 to 8 carbon atoms (such as an acetyl group, a propionyl group, a benzoyl group a mesyl group), an acyloxy group having 1 to 3 carbon atoms (such as an acetoxy group), an alkoxycarbonyl group having 2 to 8 carbon atoms (such as a methoxycarbonyl group, an ethoxycarbonyl group, a benzyloxycarbonyl group), a carbamoyl group having 1 to 8 carbon atoms (such as a carbamoyl group, an N,N-dimethylcarbamoyl group, a morpholinocarbonyl group, a piperidinocarbonyl group), a sulfamoyl group having 1 to 8 carbon atoms (such as a sulfamoyl group, an N,N-dimethylsulfamoyl group, a morpholinosulfonyl group, a piperidinosulfonyl group), a cyano group, a trifluoromethyl group or a hydroxyl group.

In general formulae (I) and (II) representing sensitizing dyes to be used in the present invention, especially preferred substituents are mentioned below. $R_1$, $R_2$ and $R_3$, which are the same or different, each represents a group of the formula $-CH_2(CF_2)_bH$ (where b, which is the same as or different from a, is an integer of 1 to 8) e.g., $-CH_2CF_2H$, $-CH_2CF_2CF_2H$, $-CH_2CF_2CF_2CF_2H$, $-CH_2CF_2CF_2CF_2CF_2H$, $-CH_2(CF_2)_6H$, $-CH_2(CF_2)_8H$, etc., or an unsubstituted alkyl group having 1 to 6 carbon atoms (such as a methyl group, an ethyl group, a propyl group, a butyl group, a pentyl group, a vinylmethyl group, a cyclohexyl group), or a substituted alkyl group having 1 to 12 carbon atoms, i.e., an alkyl group having 1 to 6 carbon atoms and having a substituent selected from the group consisting of a carboxyl group, a sulfo group, a cyano group, a halogen atom (such as a fluorine atom, a chlorine atom, a bromine atom), a hydroxyl group, an alkoxycarbonyl group having 2 to 6 carbon atoms, an alkoxy group having 1 to 6 carbon atoms, a monocyclic aryloxy group having 6 to 10 carbon atoms, an acyloxy group having 1 to 3 carbon atoms, an acyl group having 1 to 8 carbon atoms, a sulfamoyl group and an aryl group having 6 to 10 carbon atoms).

$R_4$, $R_5$ and $R_6$, which are the same or different, each represents a group of the formula $-(CH_2)_j(CF_2)_kF$ (where j and k, which are the same or different, each is 0 or an integer of 1 to 8; with the proviso that $8>j+k>0$), e.g., $-CH_2CF_3$, $-CH_2CF_2CF_2$, $-CH_2CF_2CF_2CF_3$, $-CH_2CH_2F$ , $-CH_2(CF_2)_4F$, $-CH_2(CF_2)_6F$, $-CH_2(CF_2)_8F$, etc., or has the same meanings as $R_1$, $R_2$ and $R_3$ above.

At least one of $R_1$, $R_2$ and $R_3$ and at least one of $R_4$, $R_5$ and $R_6$ have a carboxyl group or a sulfo group.

$V_1$, $V_2$, $V_3$, $V_4$, $V_5$, $V_6$, $V_7$ and $V_8$, which are the same or different, each represents a hydrogen atom, a halogen atom (such as a chlorine atom), an alkyl group having 1 to 4 carbon atoms (such as a methyl group, an ethyl group, a vinylmethyl group), an acyl group having 1 to 7 carbon atoms (such as an acetyl group, a propionyl group, a benzoyl group), an alkoxycarbonyl group having 2 to 8 carbon atoms (such as for example, a methoxycarbonyl group, an ethoxycarbonyl group, a benzyloxycarbonyl group), a carbamoyl group having 1 to 6 carbon atoms (such as a carbamoyl group, an N,N-dimethylcarbamoyl group, a morpholinocarbamoyl group), a sulfamoyl group having 1 to 6 carbon atoms (such as a sulfamoyl group, an N,N-dimethylsulfamoyl group, a morpholinosulfonyl group, a piperidinosulfonyl group), a cyano group, a trifluoromethyl group or a hydroxyl group.

X is an anion (such as, for example, chloride, bromide, iodide, 4-methylbenzenesulfonate, trifluoroborate, methylsulfate, hexafluorophosphate, perchlorate).

Examples of the compounds of the general formulae (I) and (II) are given below. However, the present invention is not construed to be limited thereto.

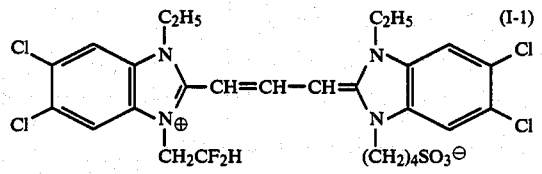
(I-1)

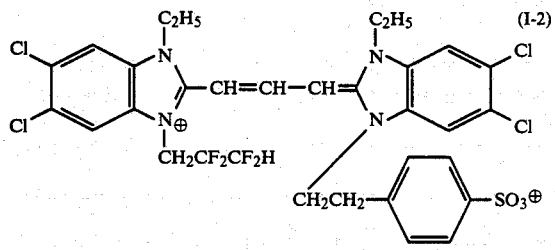
(I-2)

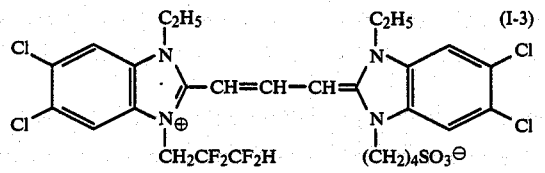
(I-3)

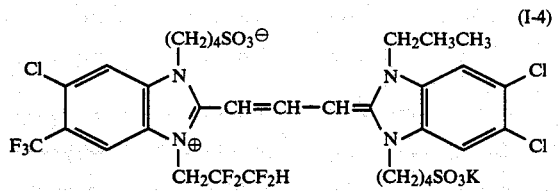
(I-4)

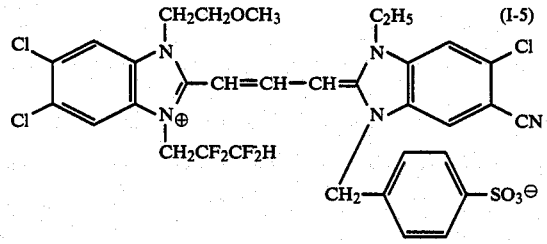
(I-5)

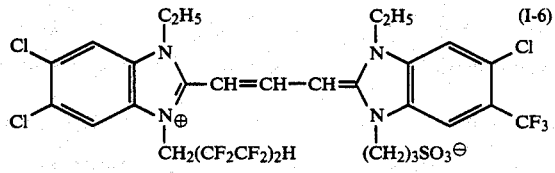
(I-6)

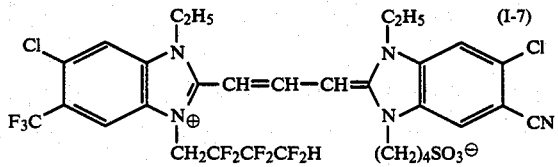
(I-7)

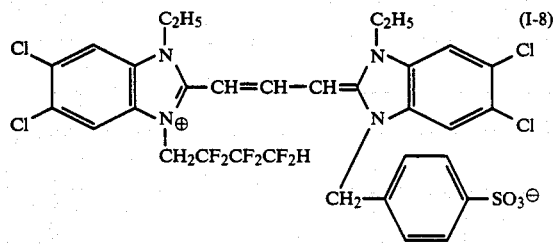
(I-8)

-continued
(I-9)
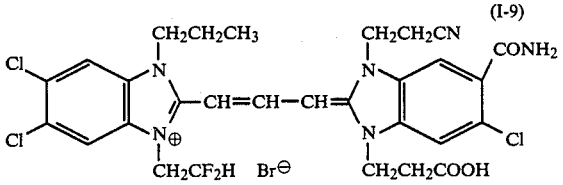
(I-10)
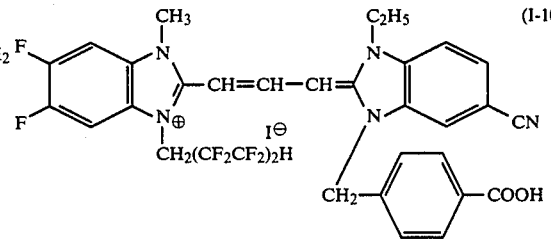
(I-11)
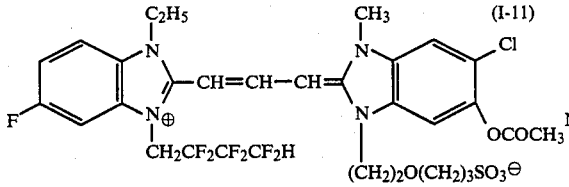
(I-12)
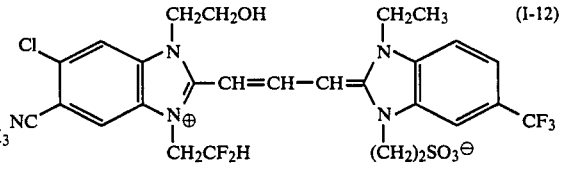
(I-13)
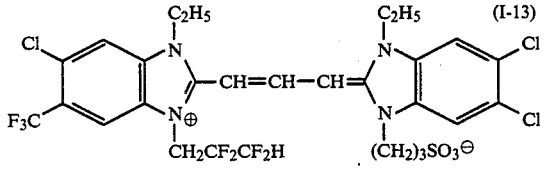
(I-14)
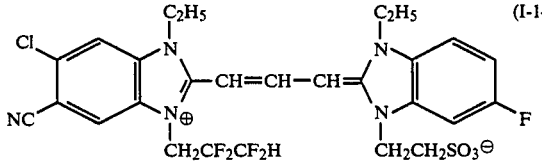
(I-15)
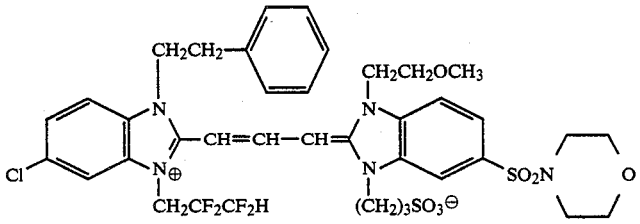
(I-16)
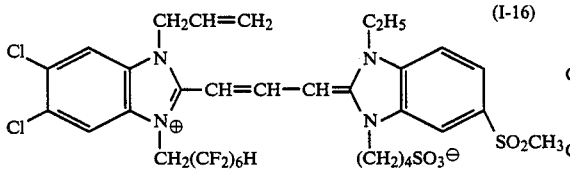
(I-17)
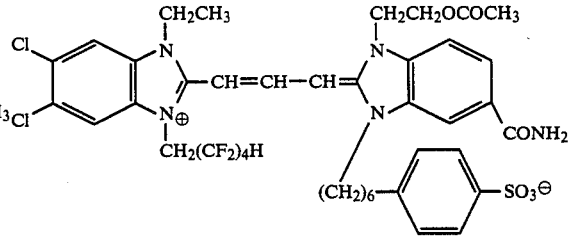
(I-18)
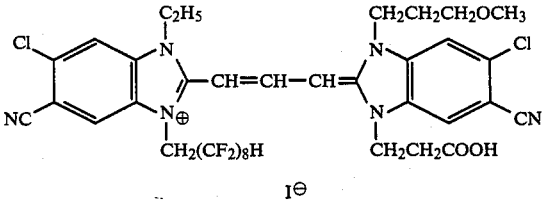
(I-19)
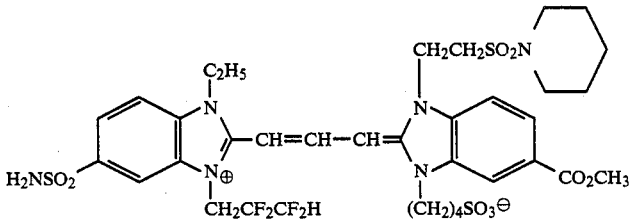

-continued
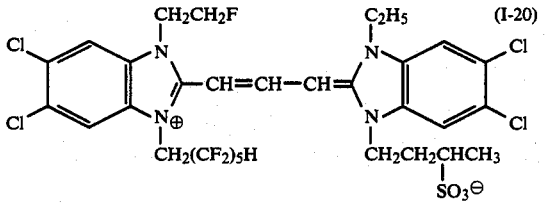
(I-20)
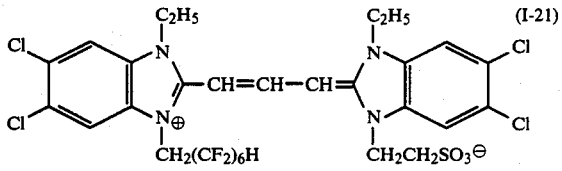
(I-21)
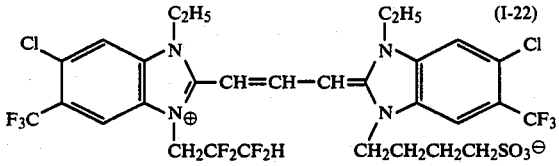
(I-22)
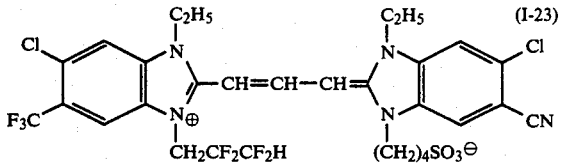
(I-23)
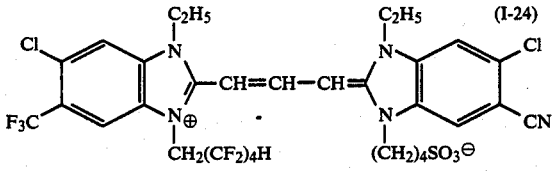
(I-24)
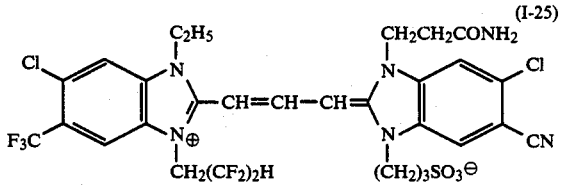
(I-25)
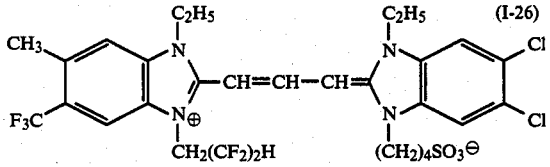
(I-26)
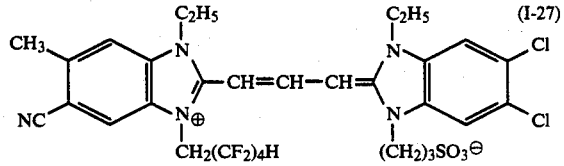
(I-27)
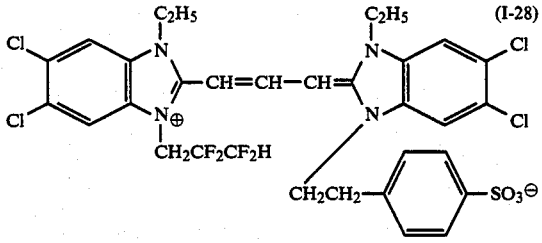
(I-28)
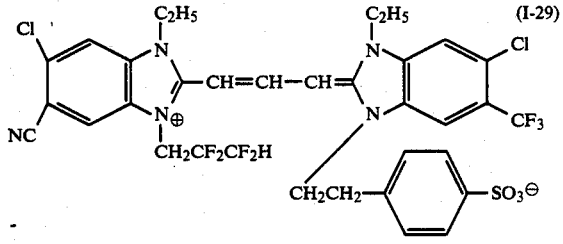
(I-29)
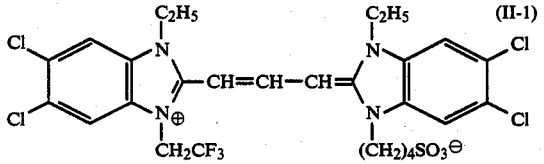
(II-1)
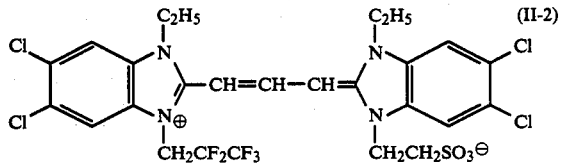
(II-2)
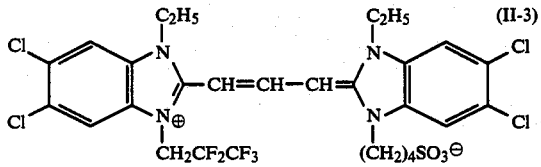
(II-3)
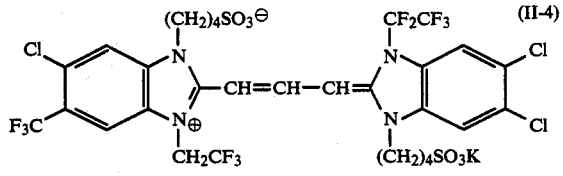
(II-4)
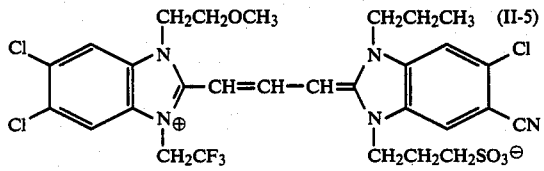
(II-5)
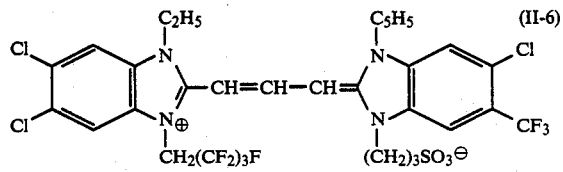
(II-6)

-continued
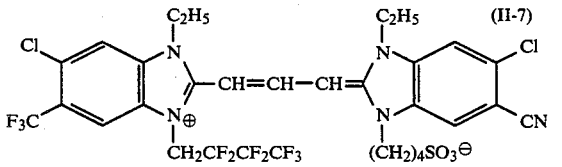
(II-7)
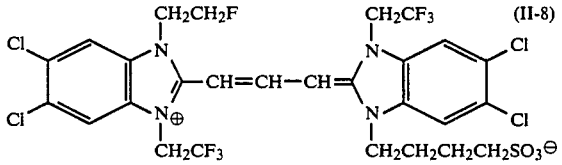
(II-8)
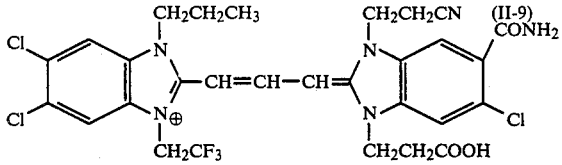
(II-9)
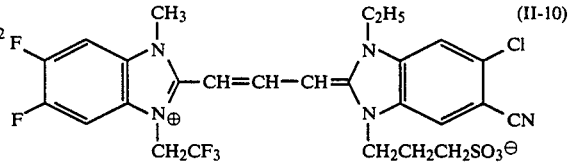
(II-10)
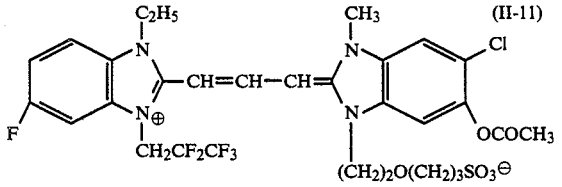
(II-11)
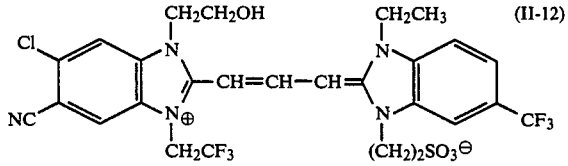
(II-12)
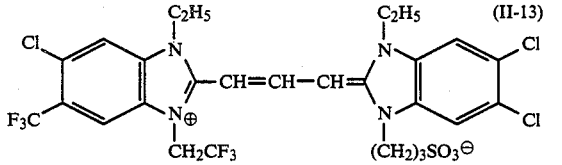
(II-13)
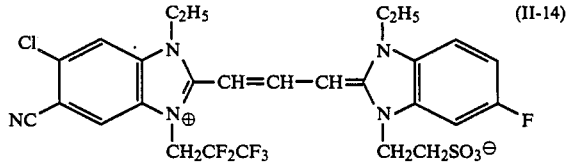
(II-14)
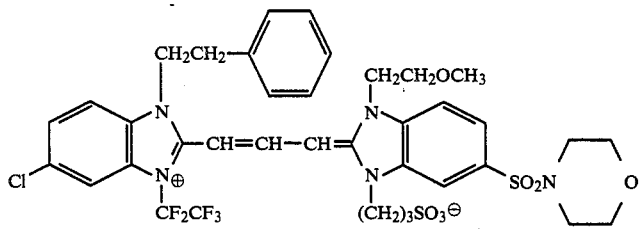
(II-15)
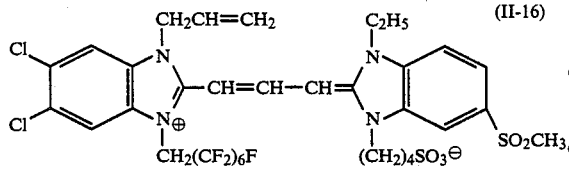
(II-16)
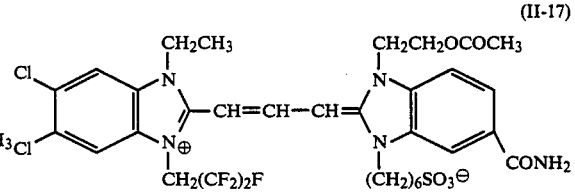
(II-17)
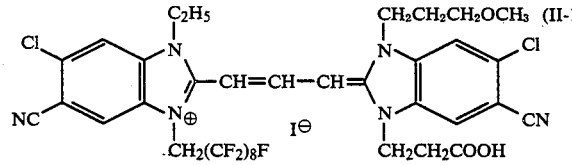
(II-18)
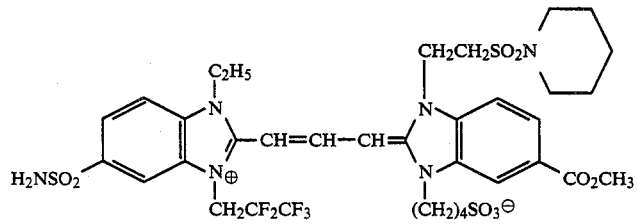
(II-19)

-continued

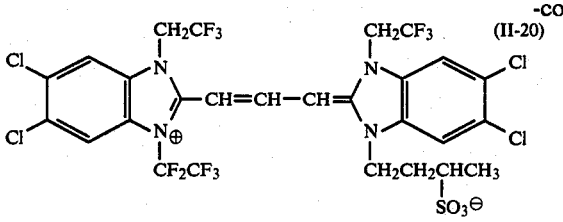

(II-20)

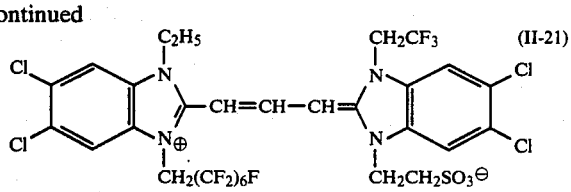

(II-21)

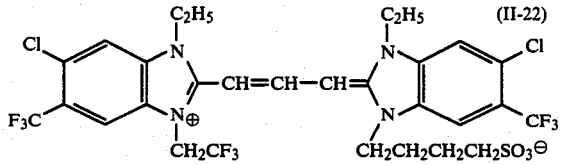

(II-22)

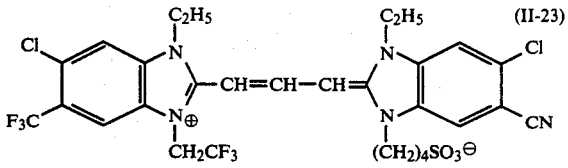

(II-23)

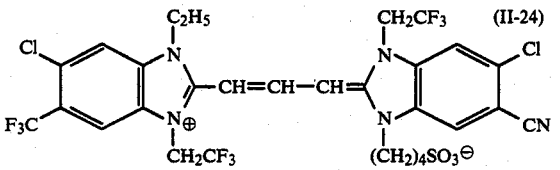

(II-24)

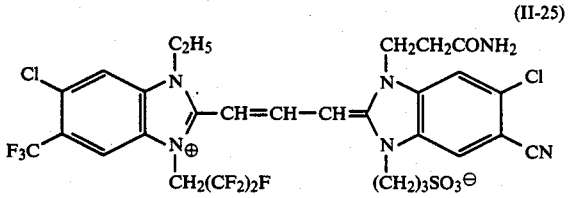

(II-25)

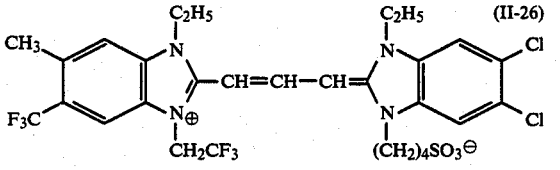

(II-26)

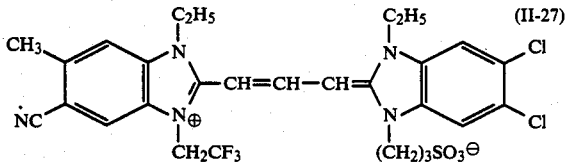

(II-27)

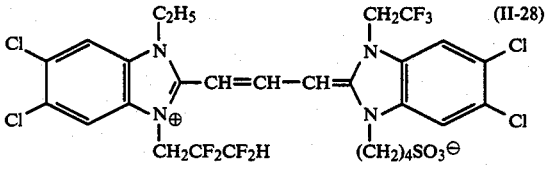

(II-28)

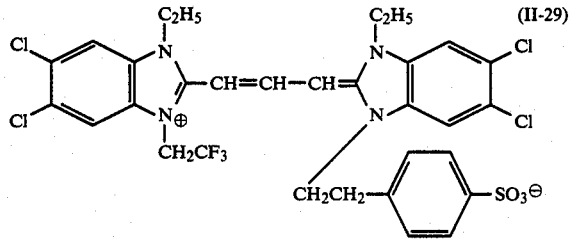

(II-29)

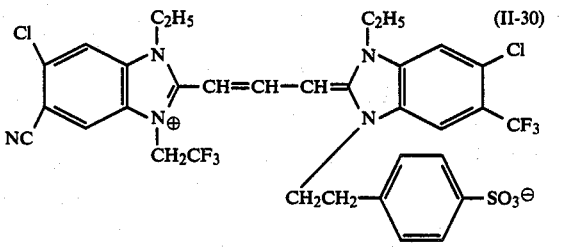

(II-30)

Of these compounds, preferred are Compounds I-1, I-2, I-3, I-4, I-7, I-13, I-22, I-23, I-28, I-29, II-1, II-2, II-3, II-7, II-13, II-22, II-23, II-24, II-27, II-29 and II-30.

Compounds represented by general formulae (I) and (II) of the present invention can easily be synthesized according to conventional methods as described in e.g., U.S. Pat. Nos. 2,912,329 and 2,739,149 and British Pat. Nos. 654,690 and 815,172 and in F. M. Hamer: "Heterocyclic Compounds - Cyanine Dyes and Related Compounds", chapter V, pages 116–147, published by John, Wiley & Sons (New York, London) in 1964, and D. M. Sturmer: "Heterocyclic Compounds - Special Topics in Heterocyclic Chemistry", chapter VIII, sec. IV, pages 482–515, published by John Wiley & Sons (New York, London) in 1977; from a fluorinated alkyl ester, a fluorinated alkylamine or a fluorinated alkyl iodide of a sulfonic acid obtained according to methods as disclosed in e.g., *J. Org. Chem.*, 26, 4021 (1961); *J. Am. Chem. Soc.*, 77, 3149 (1955); *J. Am. Chem. Soc.*, 78, 4999 (1956).

The sensitizing dye to be used in the present invention, which is represented by general formula (I) or (II), is incorporated in a silver halide photographic emulsion, in an amount of $1\times10^{-6}$ to $5\times10^{-3}$ mole, preferably $1\times10^{-5}$ to $2.5\times10^{-3}$ mole, especially preferably $4\times10^{-5}$ to $1\times10^{-3}$ mole, per mole of the silver halide.

The sensitizing dyes of the present invention may be dispersed directly in a silver halide emulsion. Alternatively, they may be dissolved first in an appropriate solvent such as methyl alcohol, ethyl alcohol, n-propanol, methyl cellosolve, acetone, water, pyridine or a mixed solvent thereof, and the resulting solution may be added to a silver halide emulsion. Ultrasonic wave may be utilized for the dissolution. Various conventional methods, for the addition of the sensitizing dyes may be used. Examples thereof include a method as described in, e.g., U.S. Pat. No. 3,469,987, in which a dye is dissolved in a volatile organic solvent, the resulting solution is dispersed in a hydrophilic colloid and the resulting dispersion is added to a silver halide emulsion; a method as described in, e.g., Japanese Patent Publication No. 24185/71, in which a water-insoluble dye is directly dispersed in a water-soluble solvent, without being dissolved, and the resulting dispersion is added to a silver halide emulsion; a method as described in, e.g., U.S. Pat. No. 3,822,135, in which a dye is dissolved in a surfactant and the resulting solution is added to a silver halide emulsion; a method as described in, e.g., Japanese Patent Application (OPI) No. 74624/76, in which a dye is dissolved in a red-shifting compound, and the resulting solution is added to a silver halide emulsion; and a method as described in, e.g., Japanese Patent Application (OPI) No. 80826/75, in which a dye is dissolved in a substantially water-free acid and the resulting solution is added to an emulsion (the term "OPI" as used herein means a "published unexamined Japanese Patent application). In addition to the above methods, for the addition of the dye-containing solution to a silver halide emulsion various other conventional methods may be used. For example, those methods as described in U.S. Pat. Nos. 2,912,343, 3,342,605, 2,996,287 and 3,429,835 can be used. The above described sensitizing dyes may uniformly be dispersed in a silver halide emulsion before the emulsion is coated on an appropriate support. Of course, the sensitizing dye may be dispersed in the emulsion in any step during the preparation of the silver halide emulsion.

Other sensitizing dyes may further be used in combination with the sensitizing dye of the present invention, and the combination of sensitizing dyes is often carried out for the purpose of super-sensitization. For example, various sensitizing dyes may be used for this purpose, such as those described in U.S. Pat. Nos. 3,703,377, 2,688,545, 3,397,060, 3,615,635, and 3,628,964; British Pat. Nos. 1,242,588 and 1,293,862; Japanese Patent Publication Nos. 4936/68, 1403/69, and 10773/68; U.S. Pat. No. 3,416,927; Japanese Patent Publication No. 4930/68; U.S. Pat. Nos. 3,615,613, 3,615,632, 3,617,295, and 3,635,721; etc.

In particular, sensitizing dyes represented by general formulae(III) and (VI) below are preferably used, in combination with the sensitizing dye of the present invention represented by general formula (I) or (II).

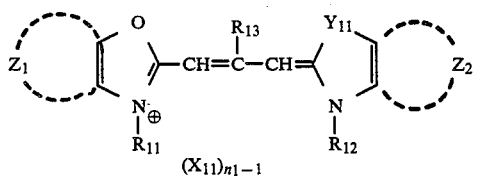

(III)

wherein $Y_{11}$ represents an oxygen atom, a sulfur atom, a selenium atom or a group of the formula N-$R_{14}$;

$Z_1$ and $Z_2$, which are the same or different, each represents an atomic group necessary to form a substituted or unsubstituted benzene or naphthalene ring;

$R_{11}$, $R_{12}$ and $R_{14}$, which are the same or different, each represents a substituted or unsubstituted alkyl group;

with the proviso that at least one of $R_{11}$, $R_{12}$ and $R_{14}$ has an acid radical;

$R_{13}$ represents a hydrogen atom, an alkyl group or an aralkyl group;

$X_{11}$ represents an anion; and $n_1$ is 1 or 2; with the proviso that when the dye forms an internal salt, $n_1$ is 1.

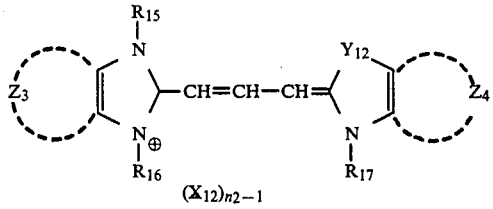

(IV)

wherein $Y_{12}$ represents a sulfur atom, a selenium atom or a group of the formula N-$R_{18}$; $Z_3$ and $Z_4$, which are the same or different, each represents an atomic group necessary to form a substituted or unsubstituted benzene or naphthalene ring;

$R_{15}$, $R_{16}$, $R_{17}$ and $R_{18}$, which are the same or different, each represents a substituted or unsubstituted alkyl group; with the proviso that at least one of $R_{15}$, $R_{16}$, $R_{17}$ and $R_{18}$ has an acid radical;

$X_{12}$ represents an anion; and $n_2$ is 1 or 2; with the proviso that when the dye forms an internal salt, $n_2$ is 1.

In the dyes represented by general formula (III), substituents represented by $Y_{11}$, $Z_1$, $Z_2$ and $R_{11}$ through $R_{13}$ are preferably as follows:

$Y_{11}$ represents an oxygen atom, a sulfur atom, a selenium atom or a group of the formula N-$R_{14}$, and more preferably represents an oxygen atom.

$Z_1$ and $Z_2$, which are the same or different, each represents an atomic group necessary to form a substituted or unsubstituted benzene or naphthalene ring.

Preferred substituents on the benzene or naphthalene ring include a halogen atom (such as a fluorine atom, a chlorine atom, a bromine atom), an alkyl group having 1 to 6 carbon atoms (such as a methyl group, an ethyl group, a propyl group, a vinylmethyl group, a 2-methylpropyl group, a butyl group, a hexyl group), an alkoxy group having 1 to 8 carbon atoms (such as a methoxy group, an ethoxy group, a butyloxy group, a benzyloxy group, a phenethyloxy group), an aryl group having 6 to 8 carbon atoms (such as a phenyl group, a 4-methylphenyl group, a 4-chlorophenyl group), an aryloxy group having 6 to 8 carbon atoms (such as a phenoxy group, a 4-methylphenoxy group, a 4-chlorophenoxy group), an acyl group having 1 to 8 carbon atoms (such as an acetyl group, a propionyl group, a benzoyl group, a mesyl group), an alkoxycarbonyl group having 2 to 8 carbon atoms (such as a methoxycarbonyl group, an ethoxycarbonyl group, a butyloxycarbonyl group, a benzyloxycarbonyl group), an acyloxy group having 1 to 3 carbon atoms (such as a acetyloxy group, a propionyloxy group), a cyano group, a trifluoromethyl group, a carboxyl group and a hydroxyl group. In particular, $Z_1$ and $Z_2$ preferably form a benzene ring substituted with a phenyl group, a chlorine atom or a methoxy group at its 5-position.

$R_{11}$, $R_{12}$ and $R_{14}$ preferably represent an alkyl group having 1 to 8 carbon atoms (such as a methyl group, an ethyl group, a propyl group, a vinylmethyl group, a butyl group, a pentyl group, a hexyl group, a heptyl group, an octyl group); or a substituted alkyl group having 1 to 16 total carbon atoms, i.e., an alkyl group having 1 to 6 carbon atoms and having a substituent selected from the group consisting of a hydroxyl group, a carboxyl group, a sulfo group, a cyano group, a halogen atom (such as a fluorine atom, a chlorine atom, a bromine atom), an alkoxycarbonyl group having 2 to 8 carbon atoms (such as a methoxycarbonyl group, an ethoxycarbonyl group, a benzyloxycarbonyl group), an alkoxy group having 1 to 8 carbon atoms (such as a methoxy group, an ethoxy group, a butyloxy group, a benzyloxy group, a phenethyloxy group), an aryloxy group having 6 to 8 carbon atoms (such as a phenoxy group, a p-tolyloxy group), an acyloxy group having 1 to 3 carbon atoms (such as an acetyloxy group, a propionyloxy group), an acyl group having 1 to 8 carbon atoms (such as an acetyl group, a propionyl group, a benzoyl group, a 4-fluorobenzoyl group), a carbamoyl group having 1 to 6 carbon atoms (such as a carbamoyl group, an N,N-dimethylcarbamoyl group, a morpholinocarbonyl group, a piperidinocarbonyl group), a sulfamoyl group having 1 to 6 carbon atoms (such as a sulfamoyl group, an N,N-dimethylsulfamoyl group, a morpholinosulfonyl group, a piperidinosulfonyl group), and an aryl group having 6 to 10 carbon atoms (such as a phenyl group, a p-fluorophenyl group, a p-hydroxyphenyl group, a p-carboxyphenyl group, a p-sulfophenyl group).

It is necessary that at least one of $R_{11}$, $R_{12}$ and $R_{14}$ has an acid radical such as, for example, a sulfonic acid group or carboxylic acid group, preferably an alkyl group having 1 to 6 carbon atoms having a sulfo group or a carboxyl group or a substituted alkyl group having 1 to 10 carbon atoms having a sulfo group or a carboxyl group, e.g., $-CH_2COOH$, $-CH_2CH_2COOH$, $-CH_2CH_2SO_3H$, $-CH_2CH_2CH_2COOH$, $-CH_2CH_2CH_2SO_3H$, $-CH_2CH_2CH_2CH_2CH_2COOH$, $-CH_2CH_2CH_2CH_2SO_3H$, $-CH_2CH_2CH_2CH_2CH_2SO_3H$, $-CH_2CH(CH_3)CH_2SO_3H$, etc.

$R_{13}$ preferably represents a hydrogen atom, an alkyl group having 1 to 4 carbon atoms (such as a methyl group, an ethyl group, a propyl group, a butyl group) or an aralkyl group having 7 to 10 carbon atoms (such as a benzyl group, a phenethyl group, a 3-phenylpropyl group).

In the dyes of general formula (IV), which may be used in the present invention, $Y_{12}$, $Z_3$, $Z_4$ and $R_{15}$ through $R_{17}$ are preferably as follows:

$Y_{12}$ is preferably a sulfur atom, a selenium atom or a group of the formula $N-R_{18}$; and $Z_3$ and $Z_4$, which are the same or different, each preferably represents an atomic group necessary to form a substituted or unsubstituted benzene or naphthalene ring.

Preferred substituents on the benzene or naphthalene ring include a halogen atom (such as a fluorine atom, a chlorine atom, a bromine atom), an alkyl group having 1 to 6 carbon atoms (such as a methyl group, an ethyl group, a propyl group, a vinylmethyl group, a 2-methylpropyl group, a butyl group, a hexyl group), an alkoxy group having 1 to 8 carbon atoms (such as a methoxy group, an ethoxy group, a butyloxy group, a benzyloxy group, a phenethyloxy group), an aryl group having 6 to 8 carbon atoms (such as a phenyl group, a 4-methylphenyl group, a 4-chlorophenyl group), an aryloxy group having 6 to 8 carbon atoms (such as a phenoxy group, a 4-methylphenoxy group, a 4-chlorophenoxy group), an acyl group having 1 to 8 carbon atoms (such as an acetyl group, a propionyl group, a benzoyl group, a mesyl group), an alkoxycarbonyl group having 2 to 8 carbon atoms (such as a methoxycarbonyl group, an ethoxycarbonyl group, a butyloxycarbonyl group, a benzyloxycarbonyl group), an acyloxy group having 1 to 3 carbon atoms (such as an acetyloxy group, a propionyloxy group), a cyano group, a trifluoromethyl group, a carboxyl group and a hydroxyl group.

$R_{15}$, $R_{16}$, $R_{17}$ and $R_{18}$ preferably represent an alkyl group having 1 to 8 carbon atoms (such as a methyl group, an ethyl group, a propyl group, a vinylmethyl group, a butyl group, a pentyl group, a hexyl group, a heptyl group, an octyl group); or a substituted alkyl group having 1 to 16 total carbon atoms, i.e., an alkyl group having 1 to 6 carbon atoms and having a substituent selected from the group consisting of a hydroxyl group, a carboxyl group, a sulfo group, a cyano group, a halogen atom (such as a fluorine atom, a chlorine atom, a bromine atom), an alkoxycarbonyl group having 2 to 8 carbon atoms (such as a methoxycarbonyl group, an ethoxycarbonyl group, a benzyloxycarbonyl group), an alkoxy group having 1 to 8 carbon atoms (such as a methoxy group, an ethoxy group, a butyloxy group, a benzyloxy group, a phenethyloxy group), an aryloxy group having 6 to 8 carbon atoms (such as a phenoxy group, a 4-methylphenoxy group, a 4-chlorophenoxy group), an acyloxy group having 1 to 3 carbon atoms (such as an acetyloxy group, a propionyloxy group), an acyl group having 1 to 8 carbon atoms (such as an acetyl group, a propionyl group, a benzoyl group, a 4-fluorobenzoyl group), a carbamoyl group having 1 to 6 carbon atoms (such as a carbamoyl group, an N,N-dimethylcarbamoyl group, a morpholinocarbonyl group, a piperidinocarbonyl group), a sulfamoyl group having 1 to 6 carbon atoms (such as a sulfamoyl group, an N,N-dimethylsulfamoyl group, a morpholinosulfonyl group, a piperidinosulfonyl group), and an aryl group having 6 to 10 carbon atoms (such as a phenyl group, a p-fluorophenyl group, a p-hydroxyphenyl group, a p-carboxyphenyl group, a p-sulfophenyl group).

It is necessary that at least one of $R_{15}$, $R_{16}$, $R_{17}$ and $R_{18}$ has an acid radical such as, for example, a sulfonic acid group or carboxylic acid group, preferably an alkyl group having 1 to 6 carbon atoms having a sulfo group or a carboxyl group or a substituted alkyl group having 1 to 10 carbon atoms having a sulfo group or a carboxyl group, e.g., $-CH_2COOH$, $-CH_2CH_2COOH$, $-CH_2CH_2SO_3H$, $-CH_2CH_2CH_2COOH$, $-CH_2CH_2CH_2SO_3H$, $-CH_2CH_2CH_2CH_2CH_2COOH$, $-CH_2CH_2CH_2CH_2SO_3H$, $-CH_2CH_2CH_2CH_2CH_2SO_3H$, $-CH_2CH(CH_3)CH_2SO_3H$, etc.

Examples of the dyes represented by general formulae (III) and (IV) are given below.

(III-1)
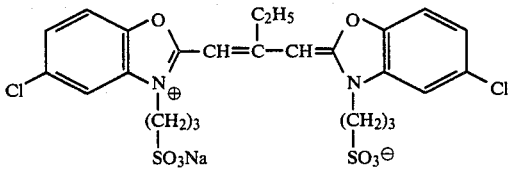
(III-2)
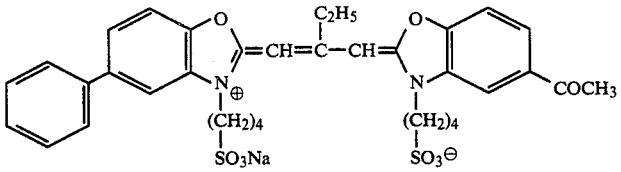
(III-3)
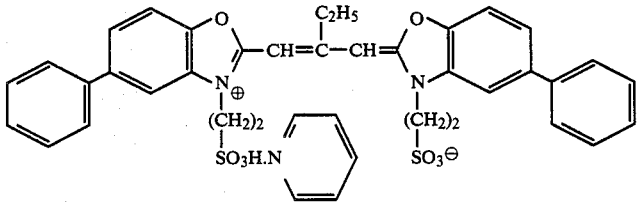
(III-4)
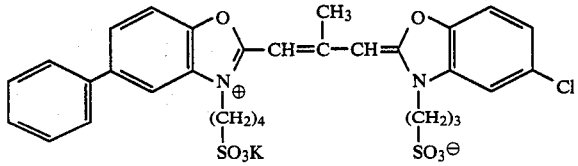
(III-5)
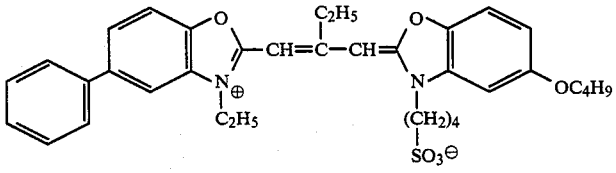
(III-6)
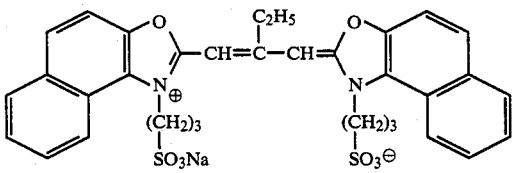
(III-7)
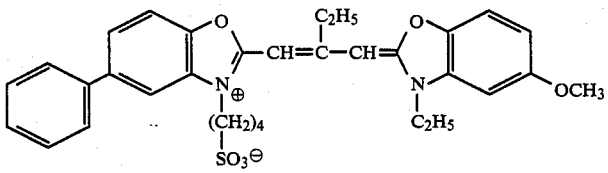
(III-8)
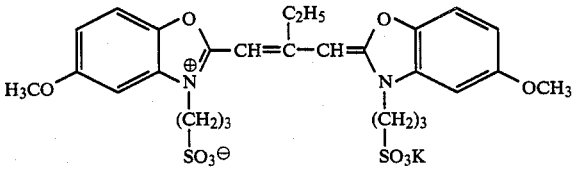

-continued
(III-9)
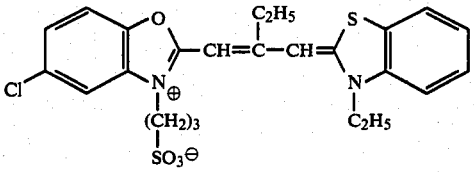
(III-10)
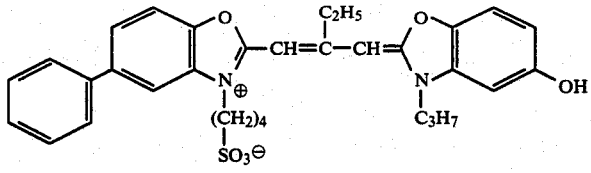
(III-11)
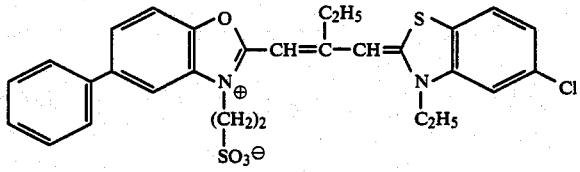
(III-12)
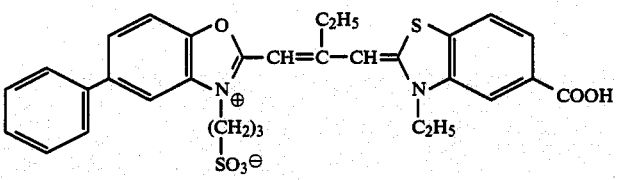
(III-13)
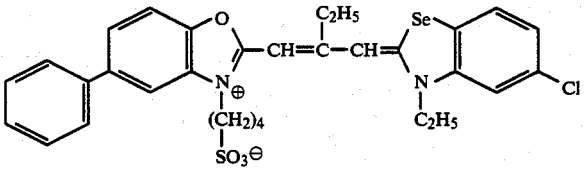
(III-14)
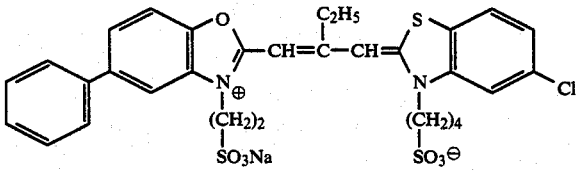
(III-15)
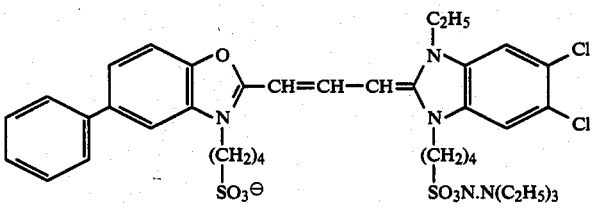
(III-16)
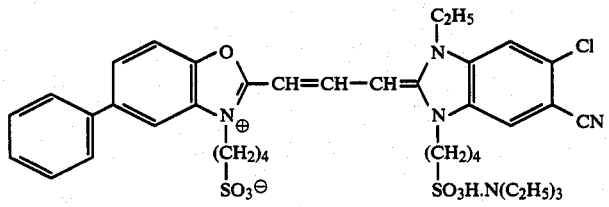

-continued
(III-17)
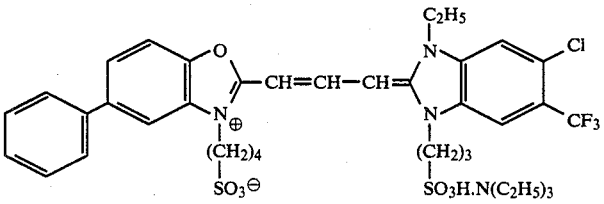
(III-18)
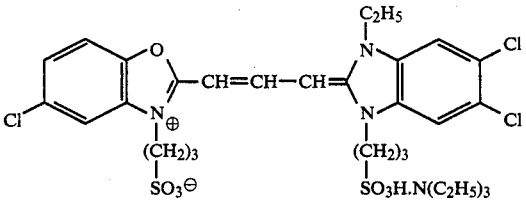
(III-19)
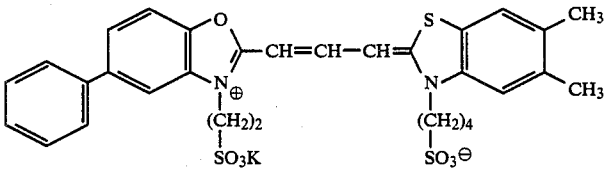
(III-20)
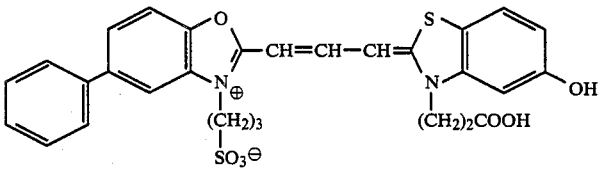
(III-21)
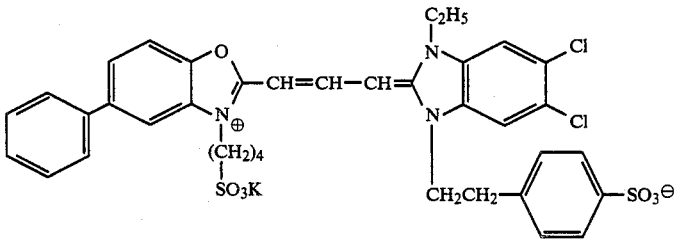
(III-22)
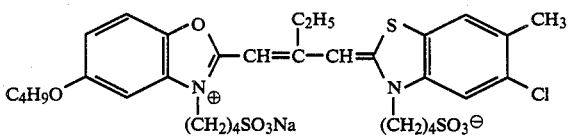
(IV-1)
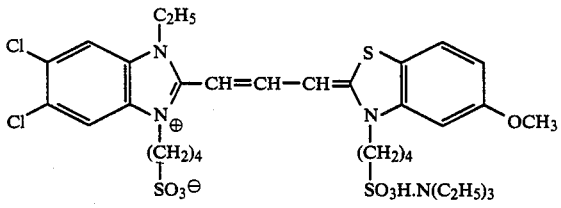
(IV-2)
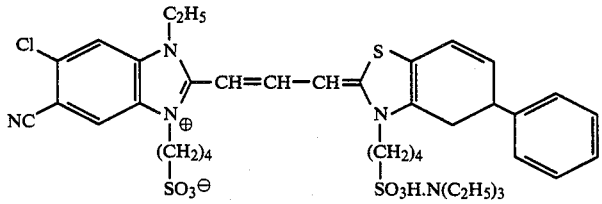

-continued
(IV-3)
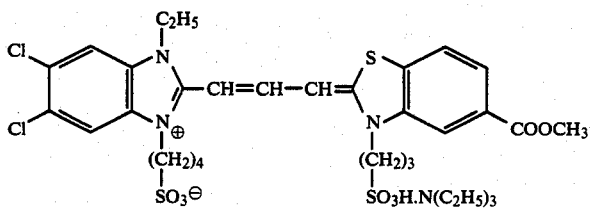
(IV-4)
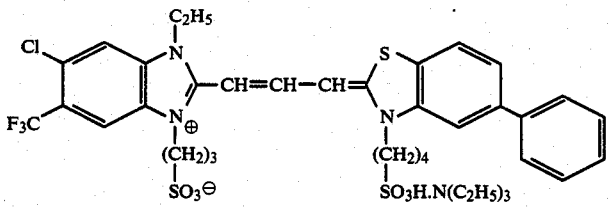
(IV-5)
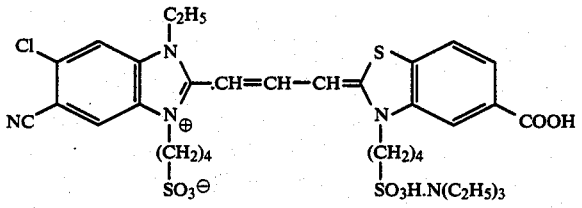
(IV-6)
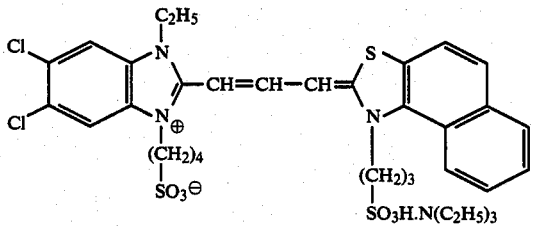
(IV-7)
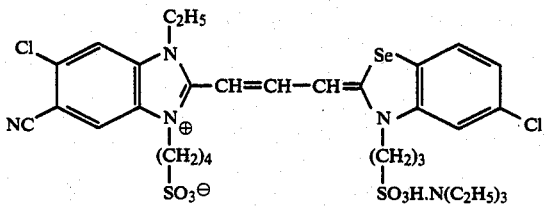
(IV-8)
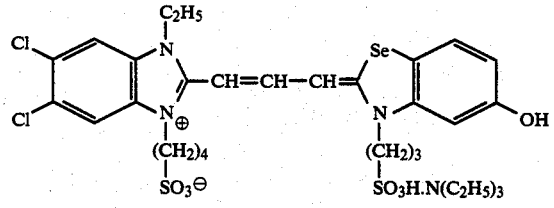
(IV-9)
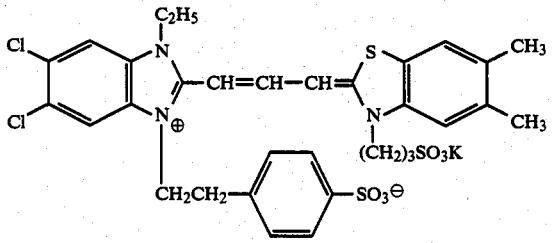

-continued (IV-10)

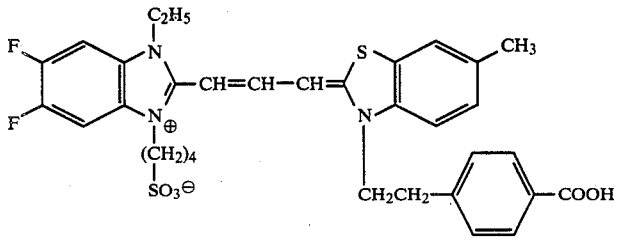

(IV-11)

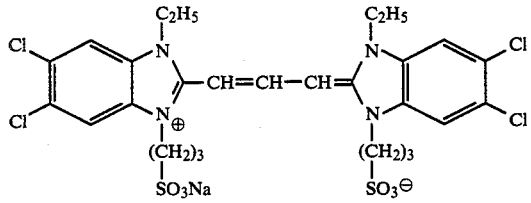

(IV-12)

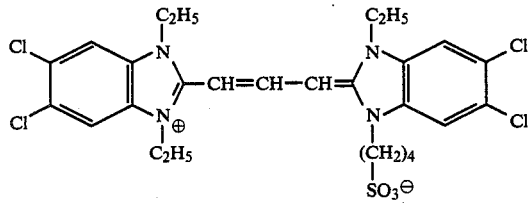

(IV-13)

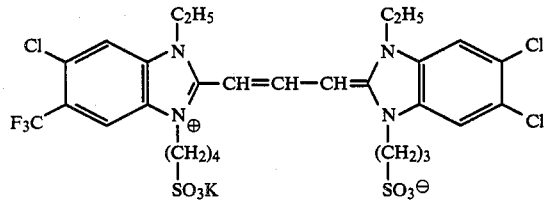

(IV-14)

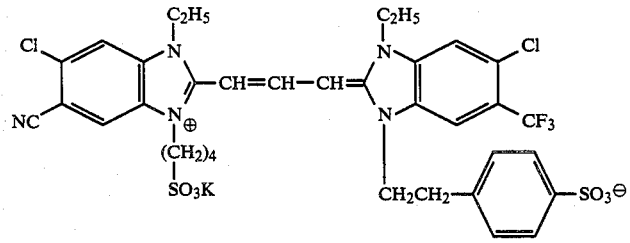

(IV-15)

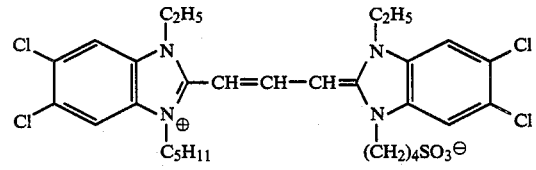

Of these compounds, preferred are Compounds III-1, III-3, III-4, III-6, III-7, III-8, III-9, III-11, III-13, III-14, III-15, III-16, III-17, IV-2, IV-3, IV-5, IV-11, IV-12, IV-13, IV-14 and IV-15.

The sensitizing dyes represented by general formulae (III) and (IV) are known, and may easily be synthesized according to the processes as described, for example, F. M. Hamer: "Heterocyclic Compounds - Cyanine Dyes and Related Compounds", chapter V, pages 116–147, published by John Wiley & Sons (New York, London) in 1964; and D. M. Sturmer: "Heterocyclic Compounds - Special Topics in Heterocyclic Chemistry", chapter VIII, sec. IV, pages 482–515, published by John Wiley & Sons (New York, London) in 1977.

The sensitizing dyes of general formulae (III) and (IV) are in general used in a molar ratio of 1/100 to 100/1, to the sensitizing dye of general formula (I) or (II) of the present invention.

In addition, compounds represented by the following general formula (V) may further be used in the present invention, in combination with the sensitizing dye of general formula (I) or (II) and/or (III) or (IV).

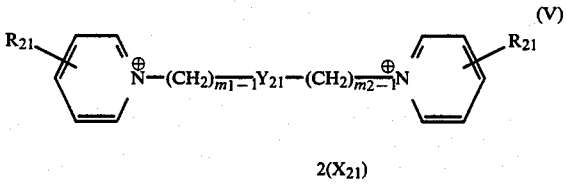

(V)

wherein $R_{21}$ represents a hydrogen atom, a halogen atom, an alkyl group, an alkoxycarbonyl group, an acyloxy group, an alkoxy group, an amino group, a substituted amino group, an acylamido group or a carbamoyl group;

$Y_{21}$ represents an alkylene group, an arylene group, an aralkylene group, or a group of the formula —COO— or —COO—$Y_{22}$—OCO—;

$Y_{22}$ represents an alkylene group having 1 to 18 carbon atoms, an arylene group having 6 to 18 carbon atoms or an aralkylene group having 7 to 18 carbon atoms;

$X_{21}$ represents an anion; and $m_1$ and $m_2$ represent an integer of 1 to 19.

In general formula (V), preferred substituents are mentioned below.

$R_{21}$ represents preferably a hydrogen atom, a halogen atom (such as a fluorine atom, a bromine atom, a chlorine atom, an iodine atom), an alkyl group having 1 to 18 carbon atoms (such as a methyl group, an ethyl group, a propyl group), an alkoxycarbonyl group having 2 to 18 carbon atoms (such as a methoxycarbonyl group, an ethoxycarbonyl group, a butoxycarbonyl group, a benzyloxycarbonyl group), an acyloxy group having 1 to 18 carbon atoms (such as an acetyloxy group, a propionyloxy group, a benzoyloxy group, a cyclohexylcarbonyloxy group), an alkoxy group having 1 to 18 carbon atoms (such as a methoxy group, an ethoxy group, a propoxy group, a butoxy group), an amino group, a substituted amino group (such as a methylamino group, an ethylamino group, a propylamino group, a dimethylamino group, a dodecylamino group, a cyclohexylamino group, a β-hydroxyethylamino group, an anilino group, a p-anisylamino group, an o-toluidino group, a 2-benzothiazolylamino group), an acylamido group (such as an acetylamido group, a propionylamido group, a benzoylamido group, a methanesulfonylamido group) or a carbamoyl group (such as a carbamoyl group, an N,N-dimethylcarbamoyl group, a morpholinocarbonyl group, a piperidinocarbonyl group).

$Y_{21}$ represents preferably an alkylene group having 1 to 18 carbon atoms (for example, a hexylene group, an octylene group, a decalene group, a methylene group, an ethylene group, a propylene group, a butylene group), and arylene group having 6 to 18 carbon atoms (for example, a phenylene group, a biphenylene group, a naphthylene group, an anthracenylene group), an aralkylene group having 7 to 18 carbon atoms

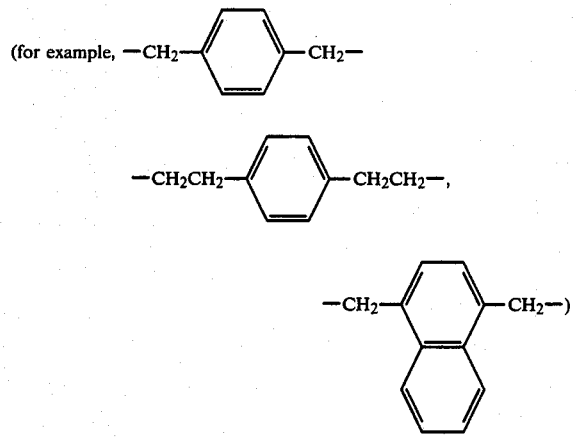

or a group of the formula —COO— or —COO—$Y_{22}$—OCO—; and $Y_{22}$ is preferably an alkylene group having 1 to 18 carbon atoms (for example, a hexylene group, an octylene group, a decalene group, a methylene group, an ethylene group, a propylene group, a butylene group, an arylene group having 6 to 18 carbon atoms (for example, a phenylene group, a biphenylene group, a naphthylene group, an anthracenylene group) or an aralkylene group having 7 to 18 carbon atoms (for example,

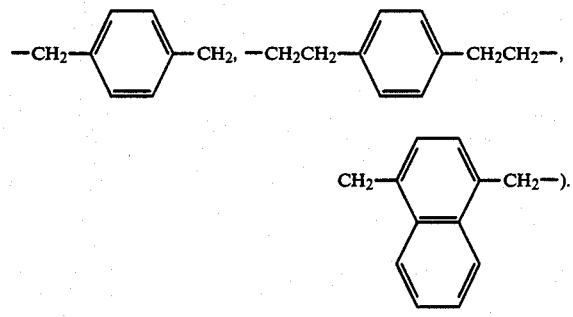

Examples of the compounds represented by the formula (V) are given below.

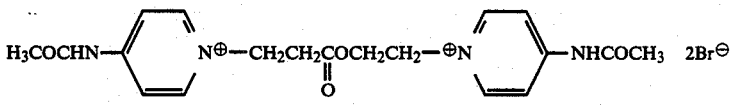

(V-1)

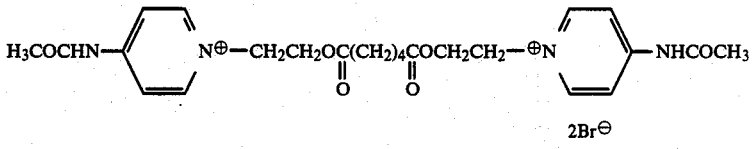

(V-2)

-continued
(V-3)
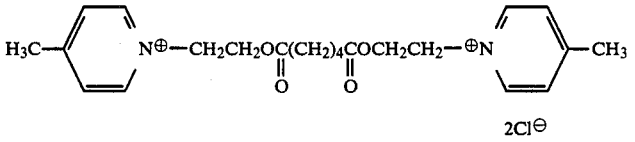
(V-4)
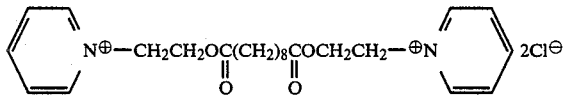
(V-5)
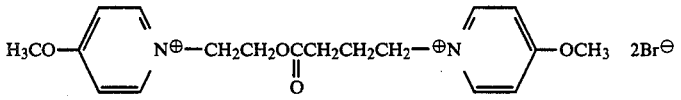
(V-6)
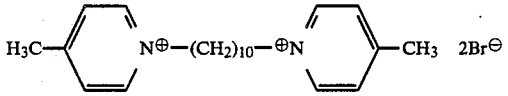
(V-7)
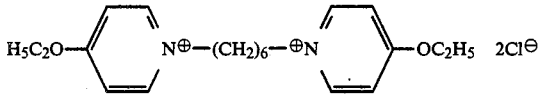
(V-8)
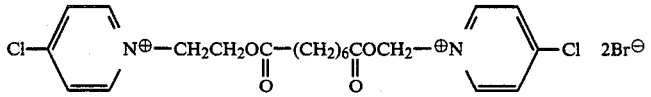
(V-9)
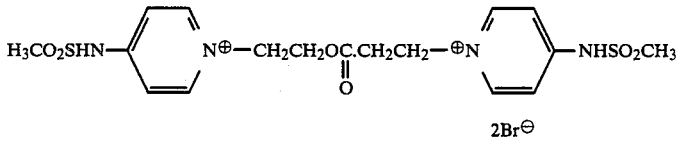
(V-10)
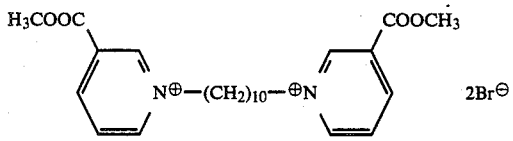
(V-11)
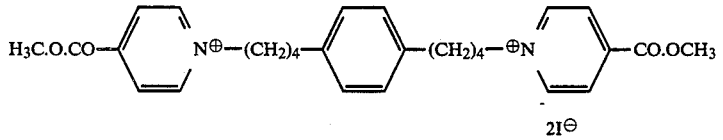
(V-12)
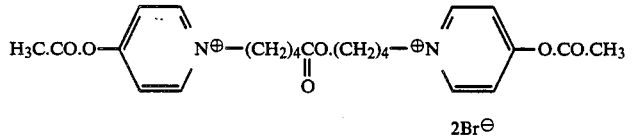
(V-13)
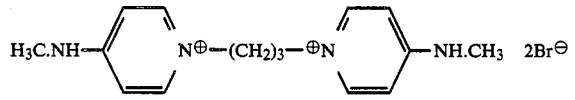

-continued

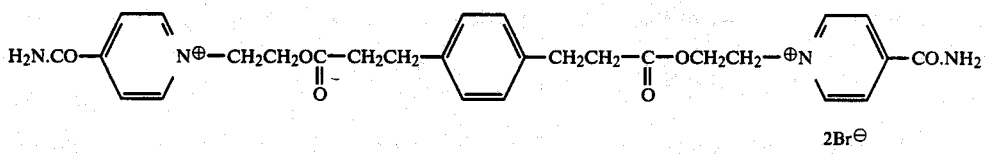

(V-14)

Of these compounds, preferred are Compounds V-1, V-2, V-3, V-4, V-6, V-7, V-8, V-10 and V-12.

The compounds of general formula (V) are known, and these may easily be synthesized by reference to a method as described in Japanese Patent Application (OPI) No. 44025/78.

In the present invention, the compounds of general formula (V) may advantageously be used in an amount of about 0.01 to 5 g, preferably 0.2 to 2.5 g, per mole of silver halide contained in the silver halide emulsion.

The ratio (weight ratio) of the sensitizing dye of general formula (I) or (II) to the compound of general formula (V) is advantageously within the range of from 100/1 to 1/100, preferably within the range of from 40/1 to 1/40, equaling (weight of the dye of general formula (I) or (II))/(weight of compound of general formula (V)).

The above described sensitizing dyes of general formulae (III) and (IV) and the compounds of general formula (V) may be added to a silver halide emulsion in the same manner as the sensitizing dyes of general formulae (I) and (II) of the present invention.

In the tabular silver halide particle-emulsion to be used in the present invention, the average aspect ratio means an average value of the ratio of the diameter to the thickness of the silver halide particles. In order to determine the diameter, the silver halide emulsion is observed under a microscope or an electron microscope, to obtain a projected area of the silver halide particle, and the diameter of a circle having the same area as the projected area is measured, which is defined to be the diameter of the present silver halide particle. Accordingly, an average aspect ratio of 5:1 or more means that the diameter of the circle is 5 times or more of the thickness of the particle.

In the tabular silver halide particles to be used in the silver halide emulsion of the present invention, the diameter of the particle is 5 times or more as large as the thickness thereof, preferably 5 to 100 times, more preferably 5 to 50 times, most preferably 8 to 30 times as large as the thickness. The proportion of the projected area occupied by tabular silver halide particles to the projected area of all the silver halide particles is 50% or more, preferably 70% or more, more preferably 85% or more. By using the above-mentioned silver halide particles in the above-mentioned proportion of the occupied projected area, silver halide photographic emulsions having high spectral sensitivity and excellent aptitude for high illumination can be obtained.

The diameter of the tabular silver halide particles is 0.5 to 10 μm, preferably 0.6 to 5.0 μm, more preferably 1 to 4 μm. The thickness of the particles is preferably 0.2 μm or less. The diameter of the tabular silver halide particles is equal to the diameter of a circle having the same area as the projected area of the silver halide particle. The thickness of the silver halide particles is represented by the distance between the two parallel surfaces constituting the tabular silver halide particles.

In the present invention, more preferred tabular silver halide particles have a particle diameter of 0.6 μm to 5.0 μm and a particle thickness of 0.2 μm or less, and have a ratio of average diameter/average thickness of 5 to 50. In particular, a silver halide photographic emulsion is especially preferred where 85% or more of the projected area of the total silver halide particles comprises tabular silver halide particles having a particle diameter of 1.0 to 5.0 μm and having a ratio of average diameter/average thickness of 8 or more.

The tabular silver halide particles which may be used in the present invention may be any of silver chloride, silver bromide, silver chlorobromide, silver iodobromide and silver chloroiodobromide particles; but it is preferred to employ silver bromide, silver iodobromide containing not more than 12 mole % silver iodide, silver chloroiodobromide containing not more than 50 mol % silver chloride and not more than 2 mol % silver iodide, and silver chlorobromide. The composition distribution in the mixed silver halide particles may be uniform or may be localized, and uniform composition distribution is more preferred. The particle size distribution may be narrow or broad.

The tabular silver halide particle-emulsions to be used in the present invention are described, e.g., in a report of *Cugnac. Chateau,* or in *Photographic Emulsion Chemistry* (by Duffin, Focal Press, New York, 1966, pp. 66–72) or *Phot. Journal* (edited by A. P. H. Trivelli, W. F. Smith, 80, (1940), page 285); and these can easily be prepared by reference to conventional methods as dcscribed in Japanese Patent Application (OPI) Nos. 113927/83, 113928/83, 127921/83, etc.

For instance, firstly seed crystals containing not less than 40% by weight of tabular particles are formed in an atmosphere of a relatively higher pAg value and a pBr value of 1.3 or less, and thereafter the seed crystals are grown by simultaneously adding a silver solution and a halogen solution thereto while the pBr value of the solution is kept analogously to such value, whereby the aimed silver halide particle emulsion may be obtained. In this particle growth procedure, the silver and halogen solutions are preferably so added that no new crystal nuclei may appear.

The size of the tabular silver halide particles can appropriately be regulated by proper controlling of temperature, proper selection of the solvent to be used and the amount thereof and proper controlling of the speed of addition of the silver salt and the halide to be used in particle growth.

In the preparation of tabular silver halide particles of the present invention, a silver halide solvent may optionally be used, if desired, whereby the particle size, the particle shape (ratio of diameter/thickness, etc.), the particle size distribution and the particle growth speed may appropriately be controlled. The amount of the solvent to be used is preferably within the range of $10^{-3}$ to 1.0 wt. %, more preferably $10^{-2}$ to $10^{-1}$ wt. %, of the reaction solution. In the present invention, the particle size distribution is apt to be mono-dispersed and the particle growth speed may be accelerated, with the increase in the amount of the used solvent, but on the contrary, the thickness of the formed particles is apt to be increased with said increase of the amount of the used solvent.

Any known and conventional silver halide solvents may be used in the present invention, including ammonia, thioethers and thioureas, which are generally used in this field of the art. Regarding thioethers, U.S. Pat. Nos. 3,271,157, 3,574,628 and 3,790,387 are referred to.

In the step of formation of silver halide particles or of physical ripening thereof, a cadmium salt, a zinc salt, a lead salt, a thallium salt, an iridium salt or a complex salt thereof, a rhodium salt or a complex salt thereof, an iron salt or a complex salt thereof, etc., may co-exist in the reaction system.

In the formation of the tabular silver halide particles to be used in the present invention, it is preferred to accelerate the speed of addition of the silver salt solution (e.g., aqueous $AgNO_3$ solution) and the halide solution (e.g., aqueous KBr solution) and to increase the amount and the concentration of the added silver salt and the halide solution, in order to accelerate the particle growth speed. For this purpose, various conventional means can be used as described in, for example, British Pat. No. 1,335,925, U.S. Pat. No. 3,650,757, No. 3,672,900 and No. 4,242,445 and Japanese Patent Application (OPI) Nos. 142329/80 and 158124/80.

The tabular silver halide particles of the present invention may optionally be chemically sensitized, if desired. For the chemical sensitization may be used various conventional methods as described in *Die Grundlagen der Photographischen Prozesse mit Silberhalogeniden* (by H. Frieser, Akademische Verlagsgesellschaft, pp. 67–734 (1968)).

For example, the chemical sensitization may be carried out by a sulfur sensitization method where a sulfur-containing compound capable of reacting with an active gelatin and silver (such as thiosulfates, thioureas, mercapto compounds, rhodanines, etc.) is used; or by a reductive sensitization method where a reducing substance (such as stannous salts, amines, hydrazine derivatives, formamidine-sulfinic acids, silane compounds, etc.) is used; or by a noble metal sensitization method where a noble metal compound (such as gold complexes as well as complex salts of Group VIII metals (of the periodic table) including platinum, iridium, palladium, etc.) is used. The chemical sensitization method may be carried out singly or in the form of a combination of two or more means.

In particular, gold sensitization or sulfur sensitization or a combination thereof is especially preferred for the tabular silver halide particles of the present invention, for the purpose of economization of the amount of silver to be used.

Gelatin is used advantageously as a binder or a protective colloid to be used in the photographic light-sensitive materials of the present invention. In addition, hydrophilic synthetic high molecular substances may also be used therefor. Various kinds of gelatins may be used, including a lime-treated gelatin, an acid-treated gelatin and gelatin derivatives.

In the photographic emulsion layer of the silver halide photographic light-sensitive materials of the present invention, various kinds of emulsions may be used other than the tabular silver halide particle-emulsion. Silver halides which may be used in the present invention include silver bromide, silver iodobromide, silver iodochlorobromide, silver chlorobromide and silver chloride. In particular, a preferred silver halide among them is silver iodobromide containing not more than 15 mol % silver iodide; and silver iodobromide containing 2 to 12 mol % of silver iodide is especially preferred.

The average particle size of the silver halide particles contained in the photographic emulsion of the present invention is not specifically limited, and is preferably 3 μm or less. The particle size corresponds to the particle diameter in the case of spherical or nearly spherical particles, or to the side length of the particle in the case of cubic particles, and the average particle size is calculated, based upon the total projected area of all particles.

The particle size distribution may be narrow or broad.

The silver halide particles to be contained in the photographic emulsion of the present invention may have a regular crystalline form such as a cubic form or an octahedral form, or alternatively may have an irregular crystalline form such as a spherical form, or otherwise may have a composite-crystal form comprising a mixture of the regular and irregular crystalline forms. The emulsion may comprise a mixture of particles of various crystalline forms.

The silvor halide particles may comprise an uniform inner phase and outer surface layer phase or may comprise different phases therebetween. The particles may be such that a latent image is formed mainly on the surface thereof or that a latent image is formed mainly in the inner part thereof.

The photographic emulsions to be used in the present invention may be prepared according to conventional methods as described in, e.g., *Chimie et Physique Photographique* (by P. Glafkides, Paul Montel Co., 1967), *Photographic Emulsion Chemistry* (by G. F. Duffin, The Focal Press Co., 1966), *Making and Coating Photographic Emulsion* (by V. L. Zelikman, et al., The Focal Press Co., 1964), etc. For example, any of acid process neutral process and ammonia process may be used, and in a system where a soluble silver salt and a soluble halogenide are reacted, any of the single-jet method or the double-jet method or a combination thereof may be used.

A process where particles are formed in the presence of an excess amount of silver ion (which is a so-called back mixing process) may be used. As one embodiment of the double-jet method, a so-called controlled-double jet method may be carried out where the pAg value is kept at a predetermined one in a liquid phase to form silver halide particles. According to this process, a silver halide emulsion containing particles having a regular crystalline form and a nearly uniform particle size may be obtained.

A mixture of two or more different silver halide emulsions may be used which have been prepared differently and individually.

During the formation of the silver halide particles or during the step of physical ripening thereof, a cadmium salt, a zinc salt, a lead salt, a thallium salt, an iridium salt or a complex salt thereof, a rhodium salt or a complex salt thereof, or an iron salt or a complex salt thereof may coexist in the reaction system.

The silver halide emulsion to be used in the present invention is in general chemically sensitized. This chemical sensitization may be carried out using the above described methods.

Various kinds of compounds may be incorporated in the photographic emulsion to be used in the present invention, which contains the above described tabular particles, in order to prevent the occurrence of fog or to stabilize the photographic characteristics during the manufacture or storage of the photographic materials or during the photographic processing thereof. For instance, various compounds which are known as an anti-fogging agent or a stabilizer may be added to the present photographic emulsion, including azoles such as benzothiazolium salts, nitroimidazoles, triazoles, benzotriazoles, benzimidazoles (especially nitro- or halogen-substituted derivatives); heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines; derivatives of the heterocyclic mercapto compounds having a water-soluble group such as a carboxyl group or a sulfone group; thioketo compounds such as oxazolinethione; azaindenes such as triazaindes, tetraazaindenes [especially 4-hydroxy-substituted-(1,3,3a,7)-tetraazaindenes); benzenethiosulfonic acids; benzenesulfinic acids; etc. Examples of such compounds and means how to use such compounds are described in e.g., U.S. Pat. Nos. 3,954,474, 3,982,947 and 4,021,248; and Japanese Patent Publication No. 28660/77.

The photographic light-sensitive materials of the present invention may contain various kinds of surfactants, in the photographic emulsion layer or in the other hydrophilic colloid layer, for various purposes of coating assistance, static charge prevention, slide property improvement, dispersive emulsification, anti-adhesion and photographic characteristic improvement (for example, development acceleration, high contrast achievement, sensitization).

Thc photographic emulsion layer of the photographic light-sensitive materials of the present invention may further contain, for the purpose of sensitivity increment, contrast increment and development acceleration, polyoxyalkylene oxides or derivatives thereof such as ethers, esters or amines thereof, thioether compounds, thiomorpholines, quaternary ammonium salt compounds, urethane derivatives, urea derivatives, imidazole derivatives, 3-pyrazolidone derivatives, etc.

In addition, the photographic materials of the present invention may contain a water-insoluble or water-sparingly soluble synthetic polymer dispersion, in the photographic emulsion layer or in an other hydrophilic colloid layer, for the purpose of improvement of dimensional stability, etc.

The photographic emulsions to be used in the present invention, with the exception of the tabular silver halide particle-containing emulsion layer, may optionally be spectrally sensitized by means of methine dyes or the like sensitizing dyes. Dyes which may be used for the purpose of spectral sensitization include cyanine dyes, merocyanine dyes, complex cyanine dyes, complex merocyanine dyes, holopolar cyanine dyes, hemicyanine dyes, styryl dyes and hemioxonol dyes. Especially valuable dyes are those belonging to cyanine dyes, merocyanine dyes and complex merocyanine dyes.

The present invention may be applied to multi-layer color photographic light-sensitive materials having at least two layers of different sensitivity on a support. Multi-layer color photographic light-sensitive materials have, in general, at least one red sensitive emulsion layer, at least one green-sensitive emulsion layer and at least one blue-sensitive emulsion layer on a support. The order of these layers to be laminated on the support may freely be selected in accordance with the use of the photographic materials. In general, the red-sensitive emulsion layer contains a cyan-forming coupler, the green-sensitive emulsion layer contains a magenta-forming coupler and the blue-sensitive emulsion layer contains a yellow-forming coupler, and the combination may optionally and freely be varied, if desired.

The photographic emulsion layer of the photographic light-sensitive materials of the present invention may contain a color-forming coupler, that is, a compound which may develop a color in color development processing by oxidation coupling with an aromatic primary amine developing agent (for instance, a phenylenediamine derivative or aminophenol derivative), in combination with a polymer coupler latex; or alternatively, when the color-forming coupler may be incorporated singly in the emulsion layer in which the polymer coupler latex is not used. For example, magenta couplers include 5-pyrazolone couplers, pyrazolone-benzimidazole couplers, cyanoacetylcoumarone couplers, ring-opened acylacetonitrile couplers, etc.; yellow couplers include acylacetamide couplers (for example, benzoylacetanilides and pivaloylacetanilides), etc.; and cyan couplers include naphthol couplers, phenol couplers, etc. These couplers are preferably non-diffusible ones having a hydrophobic group, which is called a ballast group, in the molecule. These may be any of four equivalent or two-equivalent, to the silver ion. These may be colored couplers having a color correction effect, or otherwise may be those which may release a development inhibitor during development, (that is, so-called DIR couplers). Besides the DIR coupler, these couplers may contain colorless compound forming DIR couplers which from colorless products in a coupling reaction and release a development inhibitor.

Examples of magenta-forming couplers are described in, e.g., U.S. Pat. Nos. 2,600,788, 2,983,608, 3,062,653, 3,127,269, 3,311,476, 3,419,391, 3,519,429, 3,558,319, 3,582,322, 3,615,506, 3,834,908, and 3,891,445; German Pat. No. 1,810,464; German Patent Applications (OLS) Nos. 2,408,665, 2,417,945, 2,418,959, and 2,424,467; Japanese Patent Publication No. 6031/65; Japanese Patent Application (OPI) Nos. 74027/74, 74028/74, 129538/74, 60233/75, 159336/75, 20826/76, 26541/76, 42121/77, 58922/77, and 55122/78, etc. (the term "OLS" as used herein means a "published unexamined German patent application").

In the present invention, a conventional known method as described in e.g., U.S. Pat. No. 2,322,027 may be used for the introduction of a coupler into a silver halide emulsion layer of photographic light-sensitive materials. For example, a coupler is firstly dissolved in an alkyl phthalate (such as dibutyl phthalate, dioctyl phthalate), a phosphate (such as diphenyl phosphate, triphenyl phosphate, tricresyl phosphate, dioctylbutyl phosphate), a citrate (such as tributyl acetyl citrate), a benzoate (such as octyl benzoate), an alkylamine (such as diethyllaurylamide), a fatty acid ester (such as dibutoxyethyl succinate, dioctyl azelate), a trimesate (such as tributyl trimesate); or in an organic solvent having a boiling point of about 30° to 150° C., such as a lower alkyl acetate (e.g. ethyl acetate or butyl acetate), ethyl propionate, secondary butyl alcohol, methyl isobutyl ketone, $\beta$-ethoxyethyl acetate, methylcellosolve acetate, etc.; and then the resulting solution is dispersed in a hydrophilic colloid. The above-mentioned organic solvent of high boiling point and organic solvent of low boiling point may be blended and used, if desired. Apart from the above-described method, another method may be used where a coupler is dispersed in a polymer, as described in Japanese Patent Publication No. 39853/76 or Japanese Patent Application (OPI) No. 59943/76.

When the coupler has an acid radical such as that derived from a carboxylic acid or a sulfonic acid, the coupler may be introduced in a hydrophilic colloid in the form of an alkaline aqueous solution thereof.

The photographic light-sensitive materials of the present invention may contain an inorganic or organic hardener, in the photographic emulsion layer or in another hydrophilic colloid layer.

In the silver halide photographic light-sensitive materials of the present invention, when the hydrophilic colloid layer contains a dye or an ultraviolet absorbing agent, these may be mordanted by a cationic polymer or the like.

The present silver halide photographic light-sensitive materials may contain a hydroquinone derivative, an aminophenol derivative, a gallic acid derivative, an ascorbic acid derivative, etc. as an anticolor-foggant.

The present photographic light-sensitive materials may contain an ultraviolet absorbing agent in hydrophilic colloid layer. For example, an aryl-substituted benzotriazole compound, a 4-thiazolidone compound, a benzophenone compound, a cinnamate compound, a butadiene compound, a benzoxazole compound as well as other ultraviolet absorbing polymers may be used as an ultraviolet absorbing agent. The ultraviolet absorber may be fixed in the hydrophilic colloid layer.

The silver halide color photographic light-sensitive materials of the present invention may contain a water-soluble dye, in the hydrophilic colloid layer, as a filter dye, or for the purpose of irradiation prevention or various other purposes. Examples of the water-soluble dyes include oxonol dyes, hemioxonol dyes, styryl dyes, merocyanine dyes, cyanine dyes and azo dyes. In particular, oxonol dyes, hemioxonol dyes and merocyanine dyes are preferred among them.

The photographic light-sensitive materials of the present invention may contain, in the photographic emulsion layer or in another hydrophilic colloid layer, a whitener such as a stilbene, triazine, oxazole or coumarine whitener. These whitener may be water-soluble, or alternatively, a water-insoluble whitener may be used in the form of a dispersion.

The present photographic materials may further contain a conventional known anti-decoloration agent, and a color image stabilizing agent may be used singly or as a mixture of two or more thereof. The known anti-decoloration agent include hydroquinone derivatives, gallic acid derivatives, p-alkoxyphenols, p-oxyphenol derivatives, bisphenols, etc.

The above mentioned various kinds of materials or additives which may be used in the present invention are described in Research Disclosure Vol. 170, pp. 23–28 (RD-17643), ibid. Vol. 176, pp. 22–31 (RD-17643) (December, 1978), and ibid. Vol. 187, pp. 647–651 (RD-18716) (November, 1979) or in Patent Specifications referred to in this reference, and the known additives may selectively be used in the present invention.

The amount of silver halide coated is generally about 1 to 15 g/m$^2$ as silver.

The silver halide color photographic materials of the present invention can be prepared according to conventional methods as described in, e.g., Research Disclosure Vol. 170, pp. 23–28 (RD-17643), ibid. Vol. 176, pp. 22–31 (Rd-17643) (December, 1978) and ibid. Vol 187, pp. 647–651 (Rd-18716) (November, 1979).

For exposure of the silver halide color photographic materials obtained according to the present invention, a conventional camera may be used whereupon the exposure time is generally 1/1000 to one second, and in addition, a xenon lamp or a cathode-ray tube may also be used for exposure, whereupon the exposure time is shorter than 1/1000 second, i.e., 1/10$^4$ to 1/10$^8$ second, or on the contrary, the photographic materials may be exposed longer than one second. If desired, the spectral composition of the light to be used for exposure may properly been regulated by the use of a color filter. A laser beam may also be used for the exposure of the photographic light-sensitive materials. In addition, exposure may be carried out using light emitted from a fluorescent substance excited by an electron ray, X-ray, $\gamma$-ray or $\alpha$-ray.

The photographic supports to be used in the present invention may be any conventional ones which are used in general in conventional photographic materials, for example, a cellulose nitrate film, a cellulose acetate film, a cellulose acetate butyrate film, a cellulose acetate propionate film, a polystyrene film, a polyethylene terephthalate film, a polycarbonate film or laminated sheet thereof, or a thin glass film or a paper (such as a baryta paper, or a paper on which a polymer of an $\alpha$-olefin having 2 to 10 carbon atoms such as polyethylene, polypropylene or ethylene-butene copolymer is coated or laminated) are mentioned.

For photographic processing of the photographic materials of the present invention any and every conventional procedures and conventional treating solutions may be used, for example, as described in *Research Disclosure* Vol. 176, pp. 28–30 (RD-17643). The photographic processing may be any of a monochromatic photographic processing (i.e., a development processing for the formation of silver images) or a color photographic processing (i.e., a development for the formation of color images), which is selected in accordance with the object. The development temperature may in general be selected from the range of from 18 to 50° C., but the temperature may be lower than 18° C. or may be higher than 50° C.

The present invention can cover a special case of the development where the photographic light-sensitive material contains a developing agent therein for example, in the emulsion layer, and the photographic light-sensitive material is processed in an alkaline aqueous solution for development. In this case, a hydrophobic developing agent may be incorporated in the emulsion layer by means of various conventional methods as described in, e.g., *Research Disclosure* vol. 169 (RD-16928), U.S. Pat. No. 2,739,890, British Pat. No. 813,253 or German Pat. No. 1,547,763. Development processing may be combined with a silver salt stabilization treatment using a thiocyanate compound.

Any conventional fixing solutions may be used. Examples of the fixing agent include a thiosulfate and a thiocyanate, and in addition, any other organic sulfur compounds which are known to be effective as a fixing agent may also be used. The fixing solution may contain as a hardener a water-soluble aluminum salt.

Conventional methods may be used in the formation of color images, using the present photographic light-sensitive materials. For example, a negative-positive method (as described in, e.g., *Journal of the Society of Motion Picture and Television Engineers,* Vol. 61, pp. 667–701 (1953)) may be used for such color image formation. A color developer solution comprises, in general, an alkaline aqueous solution containing a color developing agent. The color developing agent includes conventional known primary aromatic amine developing agents, including phenylenediamines such as 4-amino-N,N-diethylaniline, 3-methyl-4-mino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline, etc.

In addition, other color developing agents may also be used as described in *Photographic Processing Chemistry* (by L. F. A. Mason, The Focal Press Co., pp. 226–229 (1966)), U.S. Pat. Nos. 2,193,015 and 2,592,364 and Japanese Patent Application (OPI) No. 64933/73.

The color developer solution may additionally contain a pH buffer agent, a development restrainer, an anti-foggant, etc. In addition, the color developer solution may further contain, if desired, a water softener, a preservative, an organic solvent, a development accelerator, a dye forming coupler, a competing coupler, a fogging agent, a development assistant, a tackifier, a polycarboxylic acid chelating agent, antioxidant, etc. Examples of the additives are described in *Research Disclosure* (RD-17643), U.S. Pat. No. 4,083,723 and German Patent Application (OPI) No. 2,622,950.

After the color develpment, the photographic emulsion layer is generally subjected to bleaching treatment. The bleaching treatment may be carried out simultaneously with the fixing treatment, or alternatively may be carried out separately therefrom. A bleaching agent may be used. Examples of the bleaching agent include polyvalent metal compounds such as iron(III)-, cobalt(III)-, chromium(VI)- or copper(II)-compounds as well as peracids, quinones and nitroso compounds. More particularly, there can be used ferricyanides, bichromates, iron(III)- or cobalt(III)-organic complexes; complexes of organic acids such as amino-polycarboxylic acids (e.g. ethylenediaminetetraacetic acid, nitrilotriacetic acid, 1,3-diamino-2-propanol-tetraacetic acid), or citric acid, tartaric acid or malic acid; persulfates and permanganates; and nitrosophenols, etc. Among them, potassium ferricyanide, sodium ethylenediaminetetraacetateiron(III) complex salt and ammonium ethylenediaminetetraacetate-iron(III) complex salt are especially preferred. Ethylenediaminetetraacetate-iron(III) complex salt may be used either in an independent bleaching solution or in a mono-bath bleach-fix solution.

To the bleach solution or bleach-fix solution may be added a bleach accelerater as described in, e.g., in U.S. Pat. Nos. 3,042,520, and 3,241,966 and Japanese Patent Publications Nos. 8506/70 and 8836/70; a thiol compound as described in e.g., Japanese Patent Application (OPI) No. 65732/78; and other various kinds of additives.

The present invention will be explained in greater detail by reference to the following Examples, which, however, are not intended to be interpreted as limiting the scope of the present invention.

EXAMPLE 1

The following layers were formed on a cellulose triacetate film support in order, to obtain a multilayer color photographic material sample No. 101.

First Layer: Antihalation Layer

-continued

| | |
|---|---|
| Gelatin layer containing: | |
| Black colloidal silver | 0.18 g/m$^2$ |
| **Second Layer: Middle Layer** | |
| Gelatin layer containing: | |
| 2,5-Di-t-pentadecylhydroquinone | 0.18 g/m$^2$ |
| Coupler (C-3) | 0.11 g/m$^2$ |
| **Third Layer: First Red-Sensitive Emulsion Layer** | |
| Gelatin layer containing: | |
| Silver iodobromide emulsion (Silver iodide: 4 mole %, Average particle size: 0.4 μm) | 0.72 g/m$^2$ The amounts indicates hereinbelow the coated silver amount) |
| Sensitizing Dye (A) | $9.0 \times 10^{-5}$ mole (per mole of silver) |
| Sensitizing Dye (B) | $3.0 \times 10^{-5}$ mole (per mole of silver) |
| Sensitizing Dye (C) | $4.2 \times 10^{-4}$ mole (per mole of silver) |
| Sensitizing Dye (D) | $3.0 \times 10^{-5}$ mole (per mole of silver) |
| Coupler (C-4) | 0.0938 g/m$^2$ |
| Coupler (C-5) | 0.31 g/m$^2$ |
| Coupler (C-6) | 0.01 g/m$^2$ |
| **Fourth Layer: Second Red-Sensitive Emulsion Layer** | |
| Gelatin layer containing: | |
| Silver iodobromide emulsion (Silver iodide: 10 mole % Average particle size: 1.0 μm) | 1.2 g/m$^2$ |
| Sensitizing Dye (A) | $7.8 \times 10^{-5}$ mole (per mole of silver) |
| Sensitizing Dye (B) | $2.2 \times 10^{-5}$ mole (per mole of silver) |
| Sensitizing Dye (C) | $3.0 \times 10^{-4}$ mole (per mole of silver) |
| Sensitizind Dye (D) | $2.2 \times 10^{-5}$ mole (per mole of silver) |
| Coupler (C-4) | 0.1 g/m$^2$ |
| Coupler (C-5) | 0.061 g/m$^2$ |
| Coupler (C-7) | 0.046 g/m$^2$ |
| **Fifth Layer: Third Red-Sensitive Emulsion Layer** | |
| Gelatin layer containing: | |
| Silver iodobromide emulsion (Silver iodide: 10 mole %, Average particle size: 1.5 μm) | 1.5 g/m$^2$ |
| Sensitizing Dye (A) | $8.0 \times 10^{-5}$ mole (per mole of silver) |
| Sensitizing Dye (B) | $2.4 \times 10^{-5}$ mole (per mole of silver) |
| Sensitizing Dye (C) | $3.3 \times 10^{-5}$ mole (per mole of silver) |
| Sensitizing Dye (D) | $2.4 \times 10^{-5}$ mole (per mole of silver) |
| Coupler (C-7) | 0.32 g/m$^2$ |
| Coupler (C-17) | 0.001 g/m$^2$ |
| **Sixth Layer: Middle Layer** | |
| Gelatin layer | |
| **Seven Layer: First Green-Sensitive Emulsion Layer** | |
| Gelatin layer containing: | |
| Silver iodobromide emulsion (Silver iodide: 5 mole %, Average particle size: 0.5 μm) | 0.55 g/m$^2$ |
| Sensitizing Dye (I-7) | $3.8 \times 10^{-4}$ mole (per mole of silver) |
| Sensitizing Dye (E) | $1.5 \times 10^{-4}$ mole (per mole of silver) |
| Coupler (C-8) | 0.29 g/m$^2$ |
| Coupler (C-3) | 0.04 g/m$^2$ |
| Coupler (C-10) | 0.055 g/m$^2$ |
| Coupler (C-11) | 0.058 g/m$^2$ |
| **Eighth Layer: Second Green-Sensitive Emulsion Layer** | |
| Gelatin Layer containing: | |
| Silver iodobromide emulsion (Silver iodide: 6 mole %, Average particle size: | 1.0 g/m$^2$ |

-continued

| | |
|---|---|
| 1.2 μm, Spherical particles) | |
| Sensitizing Dye (I-7) | $2.7 \times 10^{-4}$ mole (per mole of silver) |
| Sensitizing Dye (E) | $1.1 \times 10^{-4}$ mole (per mole of silver) |
| Coupler (C-8) | 0.25 g/m$^2$ |
| Coupler (C-3) | 0.013 g/m$^2$ |
| Coupler (C-10) | 0.009 g/m$^2$ |
| Coupler (C-11) | 0.011 g/m$^2$ |

Ninth Layer:
Third Green-Sensitive Emulsion Layer

| | |
|---|---|
| Gelatin layer containing: | |
| Silver iodobromide emulsion (Silver iodide: 8 mole %, Average particle size: 1.8 μm, Spherical particles) | 2.0 g/m$^2$ |
| Sensitizing Dye (I-7) | $3.0 \times 10^{-4}$ mole (per mole of silver) |
| Sensitizing Dye (E) | $1.2 \times 10^{-4}$ mole (per mole of silver) |
| Coupler (C-3) | 0.008 g/m$^2$ |
| Coupler (C-12) | 0.05 g/m$^2$ |
| Coupler (C-18) | 0.001 g/m$^2$ |

Tenth Layer: Yellow-Filter Layer

| | |
|---|---|
| Gelatin layer containing: | |
| Yellow colloidal silver | 0.04 g/m$^2$ |
| 2,5-Di-t-pentadecylhydroquinone | 0.031 g/m$^2$ |

Eleventh Layer:
First Blue-Sensitive Emulsion Layer

| | |
|---|---|
| Gelatin layer containing: | |
| Silver iodobromide emulsion (Silver iodide: 5 mole %, Average particle size: 0.4 μm) | 0.32 g/m$^2$ |
| Coupler (C-13) | 0.68 g/m$^2$ |
| Coupler (C-14) | 0.03 g/m$^2$ |
| Coupler (C-19) | 0.015 g/m$^2$ |

Twelfth Layer:
Second Blue-Sensitive Emulsion Layer

| | |
|---|---|
| Gelatin layer containing | |
| Silver iodobromide emulsion (Silver iodide: 10 mole %, Average particle size: 1.0 μm) | 0.29 g/m$^2$ |
| Sensitizing Dye (F) | $2.2 \times 10^{-4}$ (per mole of silver) |
| Coupler (C-13) | 0.22 g/m$^2$ |

Thirteenth Layer:
Fine Particle-Emulsion Layer

| | |
|---|---|
| Gelatin layer containing: | |
| Silver iodobromide emulsion (Silver iodide: 2 mole %, Average particle size: 0.15 μm) | 0.4 g/m$^2$ |

Fourteenth Layer:
Third Blue-Sensitive Emulsion Layer

| | |
|---|---|
| Gelatin layer containing: | |
| Silver iodobromide emulsion (silver iodide: 14 mole %, Average particle size: 2.3 μm) | 0.79 g/m$^2$ |
| Sensitizing Dye (F) | $2.3 \times 10^{-4}$ mole (per mole of silver) |
| Coupler (C-13) | 0.19 g/m$^2$ |
| Coupler (C-15) | 0.001 g/m$^2$ |

Fifteenth Layer:
First Protective Layer

| | |
|---|---|
| Gelatin layer containing: | |
| Ultraviolet absorber (C-1) | 0.14 g/m$^2$ |
| Ultraviolet absorber (C-2) | 0.22 g/m$^2$ |

In each of the above layers, gelatin hardener C-16) and a surfactant were further incorporated in addition to the above-described components, to obtain a photographic sheet sample No. 101.

Compounds used in preparation of the sample are mentioned below.

C-3

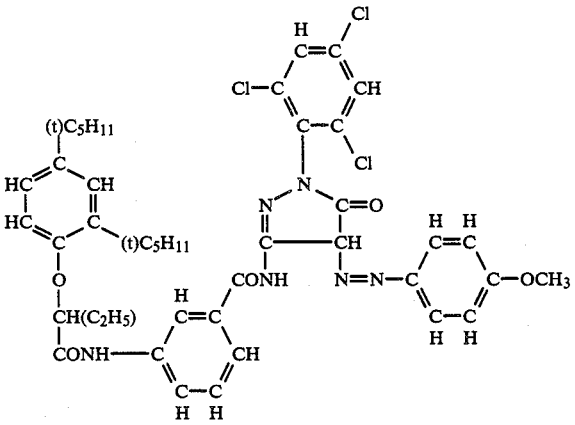

C-4

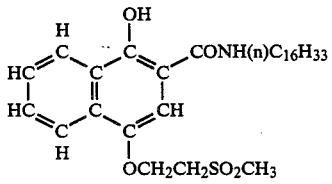

C-5

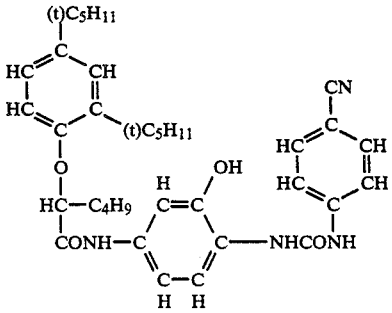

-continued
C-6
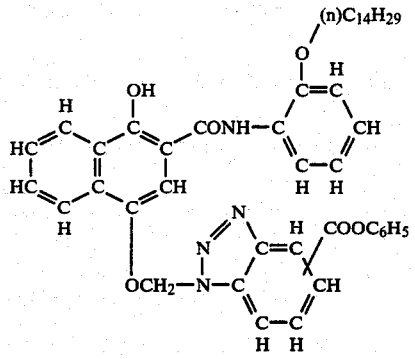
C-7
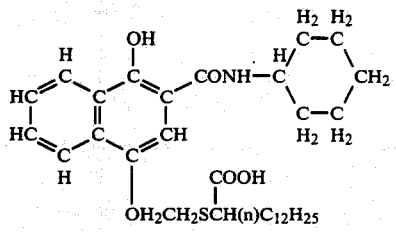
C-8
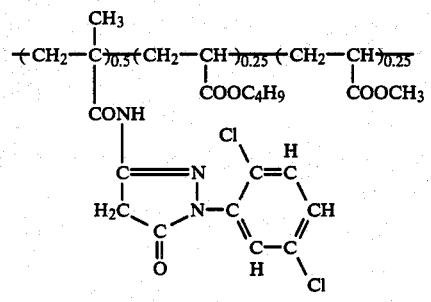
C-10
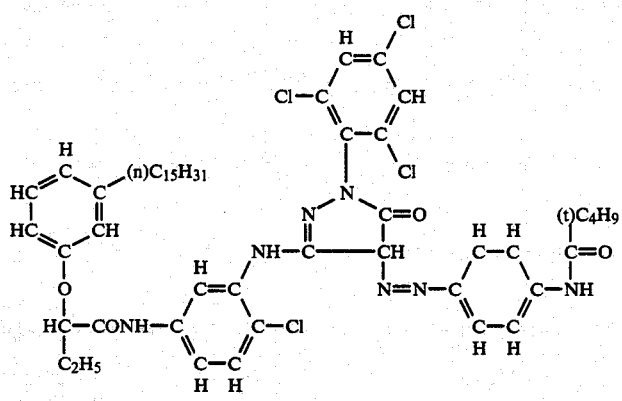
C-11
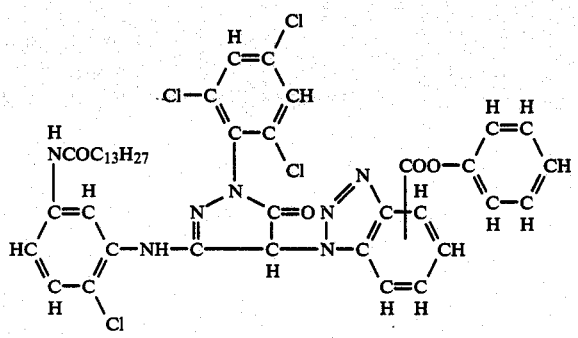

-continued
C-12
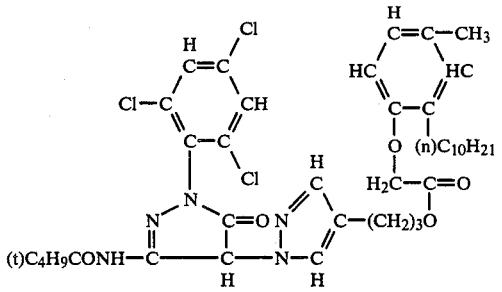
C-13
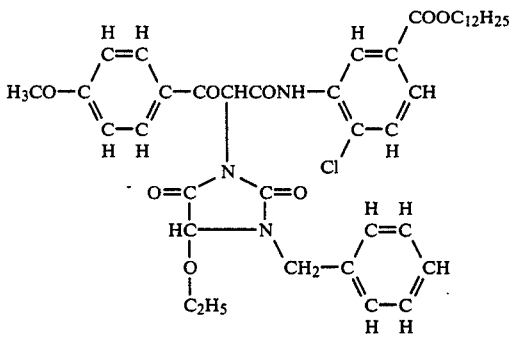
C-14
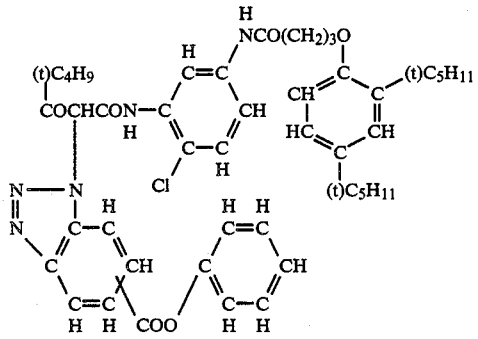
C-15
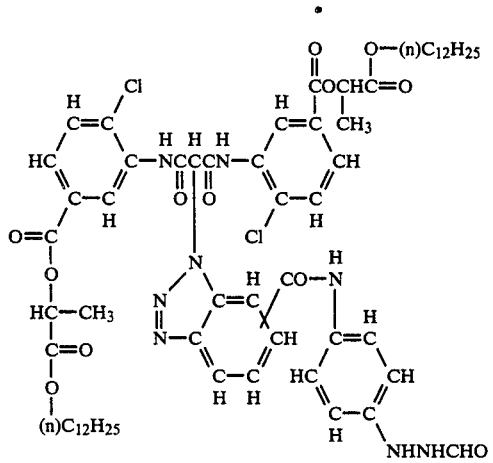
C-17
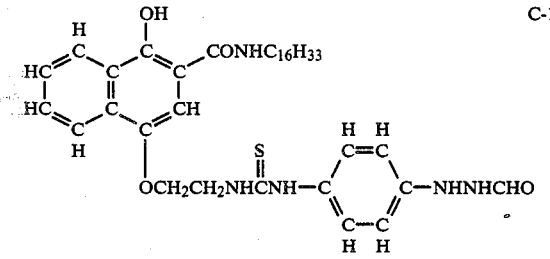
C-18
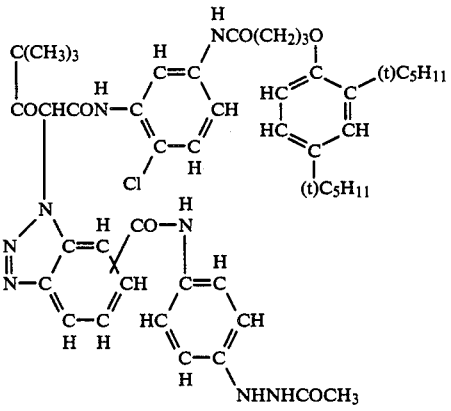
C-19
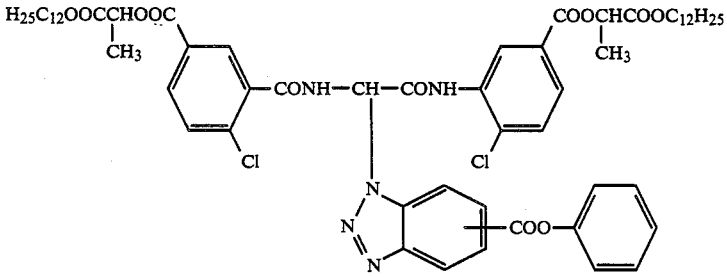

-continued

Sensitizing Dye A

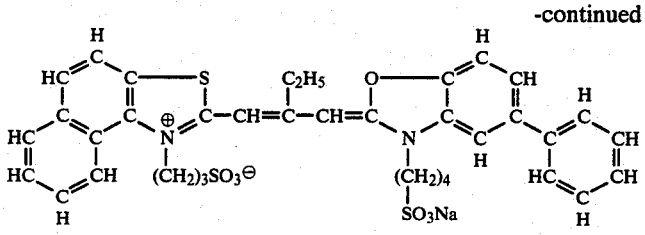

Sensitizing Dye B

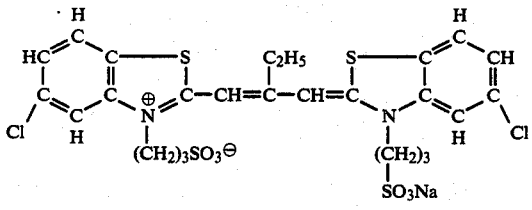

Sensitizing Dye C

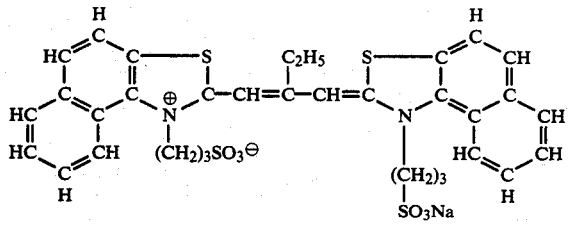

Sensitizing Dye D

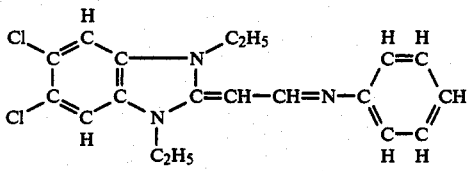

Sensitizing Dye E

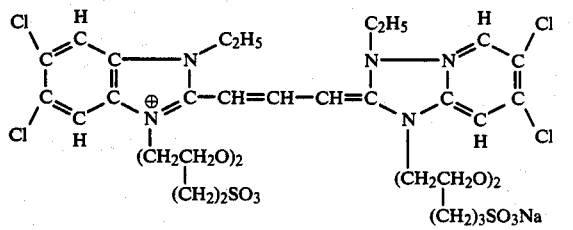

Sensitizing Dye F

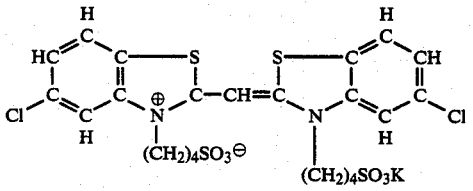

Manufacture of Sample No. 102

Another sample No. 102 was formed in the same manner as sample No. 101, with the exception that, in the 8th layer of the sample No. 101, the same amount of tabular particles having an average thickness of 0.3 micrometer and an aspect ratio of 8:1 was used instead of the spherical particles, and instead of using the Sensitizing Dye (I-7) and the Sensitizing Dye (E) $1.13\times10^{-3}$ mole of the Sensitizing Dye (E); (per mole of silver) was used for the purpose of optimum color sensitization; and that, in the 9th layer of said sample No. 101, the same amount of tabular particles having an average thickness of 0.3 micrometer and an aspect ratio of 13:1 was used instead of the spherical particles, and instead of using the Sensitizing Dye (I-7) and the Sensitizing Dye (E) $1.26\times10^{-3}$ mole of the Sensitizing Dye (E) (per mole of silver) was used for the purpose of optimum color sensitization.

Manufacture of Samples Nos. 103

Another sample No. 103 was formed in the same manner as the sample No. 101, with the exception that, in the 8the layer of the sample No. 101, the same amount of tabular particles having an average thickness of 0.3 micrometer and an aspect ratio of 8:1 was used instead of the spherical particles, and $8\times10^{-4}$ mole of the Sensitizing Dye (I-7) (per mole of silver) and $3.3\times10^{-4}$ mole of the Sensitizing Dye (E) (per mole of silver) were used for the purpose of optimum color sensitization; and that, in the 9th layer of said sample No. 101, the same amount of tabular particles having an average thickness of 0.3 micrometer and an aspect ratio of 13:1 was used instead of the sperical particles, and $9\times10^{-4}$ mole of the Sensitizing Dye (I-7) (per mole of silver) and $3.6\times10^{-4}$ mole of Sensitizing Dye (E) (per mole of silver) were used for the purpose of optimum color sensitization.

Other various kinds of samples No. 104 through 109 were formed in the same manner as the above sample No. 103, with the exception that the Sensitizing Dye (E) used in the sample No. 103 was replaced by the same molar amount of Sensitizing Dye (I-2), (I-3), (I-23), (II-1), (II-3) or (II-7) respectively.

These samples Nos. 101 to 109 were then subjected to white wedge exposure and thereafter subjected to color development processing.

The color development was carried out according to the following steps, at 38° C.

| | |
|---|---|
| 1. Color development | 3 min. 15 sec. |
| 2. Bleaching | 6 min. 30 sec. |
| 3. Rinsing | 3 min. 15 sec. |
| 4. Fixation | 6 min. 30 sec. |
| 5. Rinsing | 3 min. 15 sec. |
| 6. Stabilization | 3 min. 15 sec. |

Compositions of the processing solutions

-continued

| used in each step were as follows: | |
|---|---|
| Color Developer Solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—β-hydroxyethylamino)-2-methylaniline sulfate | 4.5 g |
| Water to make | 1.0 liter |
| Bleaching Solution: | |
| Ammonium bromide | 160.0 g |
| Aqueous ammonia (28%) | 25.0 cc |
| (ethylenediaminetetraacetato) sodium iron complex | 130.0 g |
| Glacial acetic acid | 14.0 cc |
| Water to make | 1.0 liter |
| Fixing Solution: | |
| Sodium tetrapolyphosphate | 2.0 g |
| Sodium sulfite | 4.0 g |
| Ammonium thiosulfate (70%) | 175.0 cc |
| Sodium bisulfite | 4.6 g |
| Water to make | 1.0 liter |
| Stabilization Solution | |
| Formalin | 8.0 cc |
| Water to make | 1.0 liter |

In order to test the storage stability of the samples stored for a long period of time, all samples were stored, before exposure, in a room for 3 months at 30° C. and in a relative humidty of 70%; and thereafter subjected to exposure analogously to the above. Apart from this, and in order to test the latensification effect of the samples after exposure, the samples were, after exposure, kept at 50° C. and in a relative humidity of 30% for 3 days; and thereafter subjected to the same color development processing as above. All results are given in the following Table 1.

From the results shown in Table 1 it can be seen that sample No. 102 (comparative sample), which contains tabular silver halide particles, but the storage stability still is poor and is practically unacceptable, whereas samples Nos. 103 to 109 of the present invention have higher sensitivity and have excellent storage stability.

TABLE 1

| Sample No. | Green-Sensitivity | Fog-Variation (3 Months, 30° C., 70%) | Sensitivity-Variation (3 Days, 50° C., 30%) | Fog-Increment |
|---|---|---|---|---|
| 101 (Comparative Sample) | 100 | 0.02 | +0.05 | 0.10 |
| 102 (Comparative Sample) | 118 | 0.25 | +0.15 | 0.25 |
| 103 (Present Invention) | 115 | 0.06 | +0.03 | 0.08 |
| 104 (Present Invention) | 120 | 0.03 | ±0 | 0.05 |
| 105 (Present Invention) | 120 | 0.02 | ±0 | 0.05 |
| 106 (Present Invention) | 120 | 0.01 | ±0 | 0.05 |
| 107 (Present Invention) | 118 | 0.02 | ±0 | 0.05 |
| 108 (Present Invention) | 122 | 0.02 | ±0 | 0.05 |
| 109 (Present Invention) | 120 | 0.03 | ±0 | 0.05 |

EXAMPLE 2

Samples Nos. 109 and 110 were formed in the same manner as sample No. 103 above, with the exception that the following Coupler (C-21) or Coupler (C-22) was used instead of the Coupler [C-8) used in the 7th layer and the 8th layer of sample No. 103.

These samples were subjected to the same development processing and storage tests in the above Example 1, and the results of the both samples were good, analogously to the other samples of the present invention.

C-21

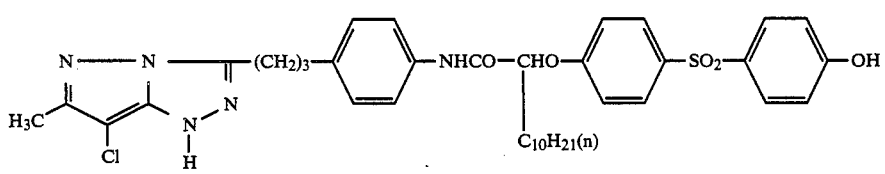

-continued

C-22

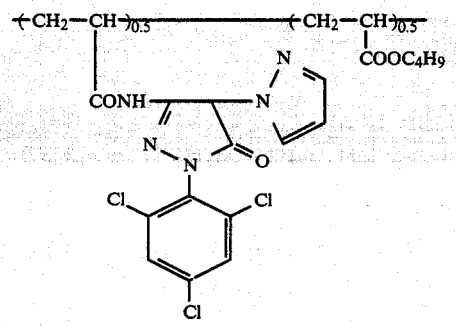

While the invention has been described in detail and with reference to specific embodiments thereof, it will be apparent to one skilled in the art that various changes and modification can be made therein without departing from the spirit and scope thereof.

What is claimed is:

1. A silver halide photographic light-sensitive material comprising a support having thereon at least one layer comprising a silver halide emulsion containing tabular silver halide particles, wherein at least 50 % of the total projected area of silver halide particles contained in the silver halide emulsion in said at least one layer is occupied by the tabular silver halide particles having an average aspect ratio of 5:1 or more, and wherein said silver halide emulsion contains at least one compound represented by general formula (I) or (II):

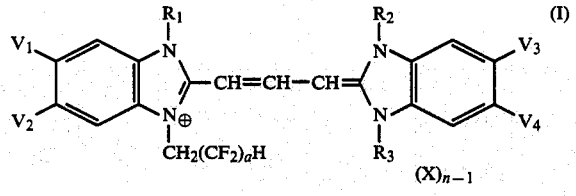

(I)

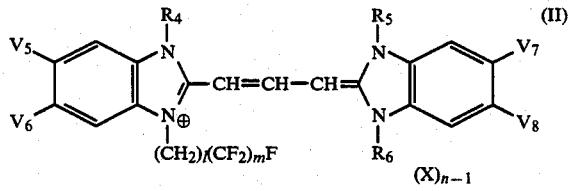

(II)

wherein a is an integer of 1 to 8;

$R_1$, $R_2$ and $R_3$, which are the same or different, each represents a group of the formula $—CH_2(CF_2)_bH$ or a substituted or unsubstituted alkyl group, with the proviso that at least one of $R_1$, $R_2$ and $R_3$ has an acid radical;

b, which is the same as or different from a, is an integer of 1 to 8;

l is 0 or an integer of 1 to 8; m is 0 or an integer of 1 to 8; with the proviso that $l+m>0$;

$R_4$, $R_5$ and $R_6$, which are the same or different, each represents a group of the formula $—(CH_2)_j(CF_2)_kF$ or a substituted or unsubstituted alkyl group, with the proviso that at least one of $R_4$, $R_5$ and $R_6$ has an acid radical; j is 0 or an integer of 1 to 8; k is 0 or an integer of 1 to 8; with the proviso that $j+k>0$;

$V_1$, $V_2$, $V_3$, $V_4$, $V_5$, $V_6$, $V_7$ and $V_8$, which are the same or different, each represents a hydrogen atom, a halogen atom, a substituted or unsubstituted alkyl group, an alkoxy group, an acyl group, an acyloxy group, an alkoxycarbonyl group, a carbamoyl group, a sulfamoyl group, a cyano group or a trifluoromethyl group;

X is an anion; and n is 1 or 2; with the proviso that when said compound forms an internal salt, n is 1.

2. The silver halide photographic light-sensitive material as claimed in claim 1, wherein said at least one silver halide emulsion layer contains a compound represented by general formula (III) or (IV);

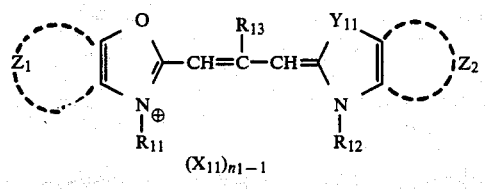

(III)

wherein $Y_{11}$ represents an oxygen atom, a sulfur atom, a selenium atom or a group of the formula $N-R_{14}$;

$Z_1$ and $Z_2$, which are the same or different, each represents an atomic group necessary to form a substituted or unsubstituted benzene or naphthalene ring;

$R_{11}$, $R_{12}$ and $R_{14}$ represent a substituted or unsubsituted alkyl group; with the proviso that at least one of $R_{11}$, $R_{12}$ and $R_{14}$ has an acid radical;

$R_{13}$ represents a hydrogen atom, an alkyl group or an aralkyl group $X_{11}$ represents an anion; and $n_1$ is 1 or 2; with the proviso that when said compound forms an internal salt, $n_1$ is 1;

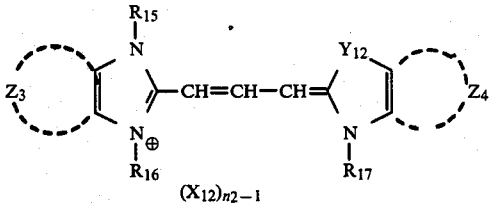

(IV)

wherein $Y_{12}$ represents a sulfur atom, a selenium atom or a group of the formula $N-R_{18}$; $Z_3$ and $Z_4$ which are the same or different, each represents an atomic group necessary to form a substituted or unsubstituted benzene or naphthalene ring;

$R_{15}$, $R_{16}$, $R_{17}$ and $R_{18}$ represent a substituted or unsubstituted alkyl group; with the proviso that at least one of $R_{15}$, $R_{16}$, $R_{17}$ and $R_{18}$ has an acid radical;

$X_{12}$ represents an anion; and $n_2$ is 1 or 2; with the proviso that when said compound forms an internal salt, $n_2$ is 1.

3. The silver halide photographic light-sensitive material as claimed in claim 2; wherein at least one silver halide emulsion layer contains a compound represented by general formula (III) or (IV):

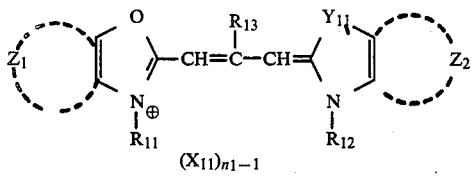

(III)

wherein $Y_{11}$ represents an oxygen atom, a sulfur atom, a selenium atom or a group of the formula N-$R_{14}$;

$Z_1$ and $Z_2$, which are the same or different, each represents an atomic group necessary to form an unsubstituted benzene or naphthalene ring or a substituted benzene or naphthalene ring having a substituent selected from the group consisting of a halogen atom, an alkyl group having 1 to 6 carbon atoms, an alkoxy group having 1 to 8 carbon atoms, an aryl group having 6 to 8 carbon atoms, an aryloxy group having 6 to 8 carbon atoms, an acyl group having 1 to 8 carbon atoms, an alkoxycarbonyl group having 2 to 8 carbon atoms, an acyloxy group having 1 to 3 carbon atoms, a cyano group, a trifluoromethyl group, a carboxyl group and a hydroxyl group;

$R_{11}$, $R_{12}$ and $R_{14}$ represent an alkyl having 1 to 8 carbon atoms, or an alkyl group having 1 to 6 carbon atoms and having a substituent selected from the group consisting of a hydroxyl group, a carboxyl group, a sulfo group, a cyano group, a halogen atom, an alkoxycarbonyl group having 2 to 8 carbon atoms, an alkoxy group having 1 to 8 carbon atoms, an aryloxy group having 6 to 8 carbon atoms, an acyloxy group having 1 to 3 carbon atoms, an acyl group having 1 to 8 carbon atoms, a carbamoyl group having 1 to 6 carbon atoms, a sulfamoyl group having 1 to 6 carbon atoms and an aryl group having 6 to 10 carbon atoms; with the proviso that at least one of $R_{11}$, $R_{12}$ and $R_{14}$ has an acid radical;

$R_{13}$ represents a hydrogen atom, an alkyl group having 1 to 4 carbon atoms or an aralkyl group having 7 to 10 carbon atoms; and $X_{11}$ and $n_1$ have the same meanings as defined above.

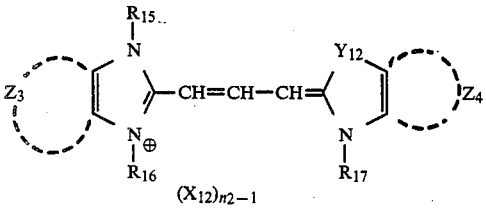

(IV)

wherein $Y_{12}$ represents a sulfur atom, a selenium atom or a group of the formula N-$R_{18}$; $Z_3$ and $Z_4$, which are the same or different, each is an atomic group necessary to form an unsubstituted benzene or naphthalene ring or a substituted benzene or naphthalene ring having a substituent selected from the group consisting of a halogen atom, an alkyl group having 1 to 6 carbon atoms, an alkoxy group having 1 to 8 carbon atoms, an aryl group having 6 to 8 carbon atoms, an aryloxy group having 6 to 8 carbon atoms, an acyl group having 1 to 8 carbon atoms, an alkoxycarbonyl group having 2 to 8 carbon atoms, an acyloxy group having 1 to 3 carbon atoms, a cyano group, a trifluoromethyl group, a carboxyl group and a hydroxyl group; $R_{15}$, $R_{16}$, $R_{17}$ and $R_{18}$ represent an alkyl group having 1 to 8 carbon atom, or an alkyl group having 1 to 6 carbon atoms and having a substituent selected from the group consisting of a hydroxyl group, a carboxyl group, a sulfo group, a cyano group, a halogen atom, an alkoxycarbonyl group having 2 to 8 carbon atoms, an alkoxy group having 1 to 6 carbon atoms, an aryloxy group having 6 to 8 carbon atoms, an acyloxy group having 1 to 3 carbon atoms, an acyl group having 1 to 8 carbon atoms, a carbamoyl group having 1 to 6 carbon atoms, a sulfamoyl group having 1 to 6 carbon atoms and an aryl group having 6 to 10 carbon atoms; with the proviso that at least one of $R_{15}$, $R_{16}$, $R_{17}$ and $R_{18}$ has an acid radical; and $X_{12}$ and $n_2$ have the same meanings as defined above.

4. The silver halide photographic ligh-sensitive material as claimed in claim 1, wherein at least one silver halide emulsion layer contains a compound represented by general formula (V):

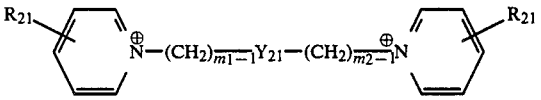

(V)

wherein $R_{21}$ represents a hydrogen atom, a halogen atom, an alkyl group, an alkoxycarbonyl group, an acyloxy group, an alkoxy group, an amino group, a substituted amino group, an acylamido group or a carbamoyl group;

$Y_{21}$ represents an alkylene group, an arylene group, an aralkylene group or a group of the formula —COO—or —COO—$Y_{22}$—OCO—;

$Y_{22}$ represents an alkylene group having 1 to 18 carbon atoms, an arylene group having 6 to 18 carbon atoms or an aralkylene group having 7 to 18 carbon atoms; $X_{21}$ represents an anion; and $m_1$ and $m_2$, each is an integer of 1 to 19.

5. The silver halide photographic light-sensitive material as claimed in claim 1, wherein said at least one compound represented by general formula (I) or (II) is contained in an amount of 1 to $10^{-6}$ to $5\times10^{-3}$ mole per mole of the silver halide.

6. The silver halide photographic light-sensitive material as claimed in claim 5, wherein said at least one represented by general formula (I) or (II) is contained in an amount of $1\times10^{-5}$ to $2.5\times10^{-3}$ mole per mole of the silver halide.

7. The silver halide photographic light-sensitive material, as claimed in claim 2, wherein said compound represented by general formula (III) or (IV) is contained in a molar ratio of 1/100 to 100/1 to said compound represented by general formula (I) or (II).

8. The silver halide photographic light-sensitive material as claimed in claim 4, wherein said compound represented by general formula (V) is contained in an amount of about 0.01 to 5 g per mole of the silver halide.

9. The silver halide photographic light-sensitive material as claimed in claim 4, wherein the weight ratio of said at least one compound represented by general formula (I) or (II) to said compound represented by general formula (V) is from 100/1 to 1/100.

10. The silver halide photographic light-sensitive material as claimed in claim 9, wherein the weight ratio of said at least one compound represented by general formula (I) or (II) to said compound represented by general formula (V) is from 40/1 to 1/40.

11. The silver halide photographic light-sensitive material as claimed in claim 1, wherein the average aspect ratio of said tabular silver halide particles is from 5:1 to 100:1.

12. The silver halide photographic light-sensitive material as claimed in claim 11, wherein the average aspect ratio of said tabular silver halide particles is from 5:1 to 50:1.

13. The silver halide photographic light-sensitive material as claimed in claim 12, wherein the average aspect ratio of said tabular silver halide particles is from 8:1 to 30:1.

14. The silver halide photographic light-sensitive material as claimed in claim 1, wherein the proportion of the projected area occupied by said tabular silver halide particles to the projected area of all the silver halide particles is 70% or more.

15. The silver halide photographic light-sensitive material as claimed in claim 1, wherein said tabular silver halide particles have a diameter of from 0.5 to 10 μm.

16. The silver halide photographic light-sensitive material as claimed in claim 15, wherein said tabular silver halide particles have a diameter of from 0.6 to 5.0 μm.

17. The silver halide photographic light-sensitive material as claimed in claim 1, wherein said tabular silver halide particles have a thickness of 0.2 μm or less.

18. The silver halide photographic light-sensitive material as claimed in claim 1, wherein said silver halide emulsion contains at least two compounds represented by general formula (I) and/or (II).

19. The silver halide photographic light-sensitive material as claimed in claim 1, wherein said tabular silver halide particles have an average aspect ratio of 8:1 or more.

20. The silver halide photographic light-sensitive material as claimed in claim 1, wherein said at least one compound represented by general formula (I) or (II) is contained in an amount of $1\times10^{-6}$ to $5\times10^{-3}$ mole per mole of the silver halide, the average aspect ratio of said tabular silver halide particles is from 8:1 to 30:1, the proportion of the projected area occupied by said tabular silver halide particles to the projected area of all the silver halide particles is 70% or more, the tabular silver halide particles have a diameter of 0.5 to 10 μm and the tabular silver halide particles have a thickness of 0.2 μm or less.

* * * * *